United States Patent [19]

Friend

[11] 4,072,176

[45] Feb. 7, 1978

[54] AUTOMATIC WIRE HANDLING AND WRAPPING APPARATUS

[75] Inventor: Lindsay Carlton Friend, Camp Hill, Pa.

[73] Assignee: Ingersoll-Rand Company, Woodcliff Lake, N.J.

[21] Appl. No.: 761,696

[22] Filed: Jan. 24, 1977

[51] Int. Cl.[2] ..... B21F 15/00

[52] U.S. Cl. ..... 140/93 R; 29/755; 29/753

[58] Field of Search ..... 140/92.1, 93 R; 29/753, 29/755; 242/7.18, 7.17

[56] References Cited

U.S. PATENT DOCUMENTS 3,479,720 11/1969 Bohannon et al. ..... 29/753

*Primary Examiner*—Lowell A. Larson

*Attorney, Agent, or Firm*—Walter C. Vliet

[57] ABSTRACT

Disclosed is an automatic wire handling and wrapping apparatus wherein wire from a continuous feed supply is sequentially prepared and wrapped between terminals of an electrical terminal board or the like to form a connection therebetween. The wrapping is accomplished for sequential terminals by a single wire wrapping head. The unique wire handling apparatus and bit accomplish the transfer of wire to the required positions to the right and left of the wrapping bit without wasteful loss of wire in control functions or loss of control of the wire ends. Further, the unique loading characteristic of the device allows for loading of the wire wrapping bit close to the terminal thereby avoiding excessive wire loop between the terminals. The wire wrapping head may be mounted on an X-Y table for transport between terminals and the wire wrapping device is capable of moving in the direction in and out or Z direction from the terminal to accomplish the wrap at any desired level on the terminal pin.

34 Claims, 28 Drawing Figures

2
1
36
40
33
70
72
71
4
5
69
65
34
27
28
18
17
68
74
73
6
3
29
10
14
43
48
15
30
8
11
9
13
7
12
25
60
59
61
81
45
28
16
46
26
64
24
21
47
16
19
22
20
23

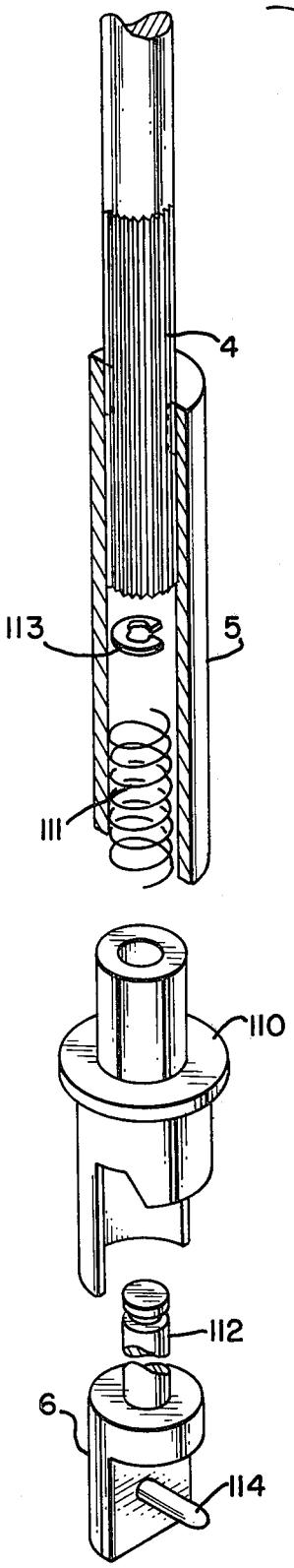
FIG. 17
FIG. 15
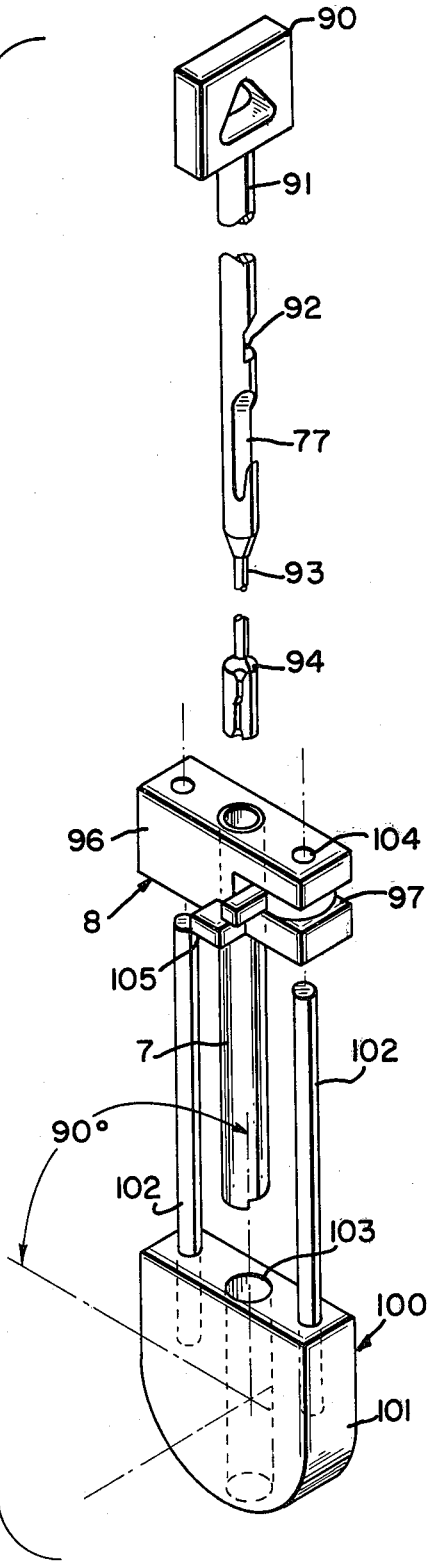

AUTOMATIC WIRE HANDLING AND WRAPPING APPARATUS

BACKGROUND OF THE INVENTION

Solderless wrapped connections between electrical terminals have become a standard means for wiring equipment such as computers, televisions, commercial communications equipment, and similar electronic apparatus. In a typical manufacturing process, two terminals are connected together with a length of wire to form an electrical connection therebetween. In the usual case, a length of wire is premeasured and prestripped at both ends, and one end of wire is inserted at a time into a wire wrapping tool, which is then placed on the terminal post. The bare wire is then coiled tightly around the post by rotary action of the tool. The wrapping process is repeated for the second end of the wire after the wire is extended to the second terminal. Hand wrapping, although considerably faster than hand soldering, is still relatively expensive, tedious, and time consuming.

For this reason, automatic wire wrapping apparatus have been developed which range in complexity from X-Y position locators capable of achieving approximately 175 wire wraps an hour to fully automatic devices capable of approximately 900 wires per hour. To date, the successful commercial operations capable of fully automatic wire wrapping require the use of multiple wire wrapping heads. Several representative efforts of this area are the machines disclosed in Madden, U.S. Pat. No. 269,656, issued Dec. 14, 1954, and Etchison, et al, U.S. Pat. No. Re. 26,791, issued Feb. 17, 1970. More recently because of the obvious savings, a number of single head wire wrapping machines which accomplish the wrapping of both ends of the wire have been devised. Representative of these efforts are Taysom, et al, U.S. Pat. No. 3,435,858, issued Apr. 1, 1969, Staiger, U.S. Pat. No. 3,774,283, issued Nov. 27, 1973, and Fidiam, U.S. Pat. No. 3,895,659, issued July 22, 1975. To date, single headed automatic wire wrapping machines have not proved completely successful for the following reasons: The devices failed to fully control the wire in all phases of the wrapping operation; the wire stripping proved inadequate because of attempts to accomplish it within the confines of the wrapping bit; or the device required the wasteful loss of a portion of the wire during the wire handling sequence in order to insure control. In addition, most of the devices required an extensive loop length between terminals because of their inability to load the wrapping bit close to the terminal without interference of the loading mechanism with the terminal board itself.

SUMMARY OF THE INVENTION

Accordingly, it is the object of the present invention to provide a simplified and low-cost apparatus for automatically performing the wire wrapping operation on computer terminal boards and the like. It is the object of the present invention to provide a machine that is fully automatic and capable of working on closely spaced terminal boards. It is an object of this invention to provide an improved wire wrapping apparatus that may be utilized with conventional X-Y locators which may be tape or otherwise driven. It is a further object of this invention to provide an improved wire wrapping apparatus which positively controls the wire in all steps of the wire handling and wrapping sequence without wire waste either from the control or positioning standpoint. These and further objects are accomplished in a wire wrapping machine comprising: A rotary wire wrapping tool; a means for feeding insulated wire of an indeterminate length to the tool; means for receiving and loading the wire on the tool including clamp means separate from but adjacent the tool; stripping means separate from but adjacent the tool for removing the wire insulation; and rotatable cutting and gripping means for cutting to length and securing alternative ends of the wire.

BRIEF DESCRIPTION OF THE INVENTION

A wire wrapping apparatus constructed in accordance with the principle of the present invention comprises a rotary wrapping tool for wrapping the stripped and cut ends of a wire on spaced terminals, means for catching and loading the wire on the tool, stripping and cutting means for forming the connector ends, and means for advancing and retracting the loaded wire wrapper bit towards and away from the terminal to be wrapped. The objects of the invention are accomplished by a transfer of the wire by means of a unique roll-over cutter clamp assembly and wire positioning device in combination with the horizontal load/vertical wrap feature of the wrapping bit. During the entire sequence of the operation, the wire is positively held in either one of the two clamp devices or the wrapping bit itself. The invention features the ability to handle automatically a continuous wire feed, cut the wire to length, strip both ends of the wire to any desired strip length, load the wire wrapping bit close to the terminals to be wrapped, and produce a wrapped terminal connection at both ends of the wire. Once the wire has been initially fed to the wire wrapping apparatus, the further handling and wire wrapping sequence may be automatically controlled and operated without further attention of the operator until such time as the apparatus completes the wire wrapping job or there is a malfunction of either the apparatus or the terminal board. The apparatus is capable of detecting faults in the terminal board itself. The apparatus and its function will be more clearly described and understood with reference to the following drawings and description.

BRIEF DESCRIPTION OF THE DRAWINGS

FIG. 15 is an exploded perspective view of the wrapping bit, latch and bit holder assembly;

FIG. 17 is an exploded perspective of the bit drive assembly;

DESCRIPTION OF THE PREFERRED EMBODIMENT

Figure 12:
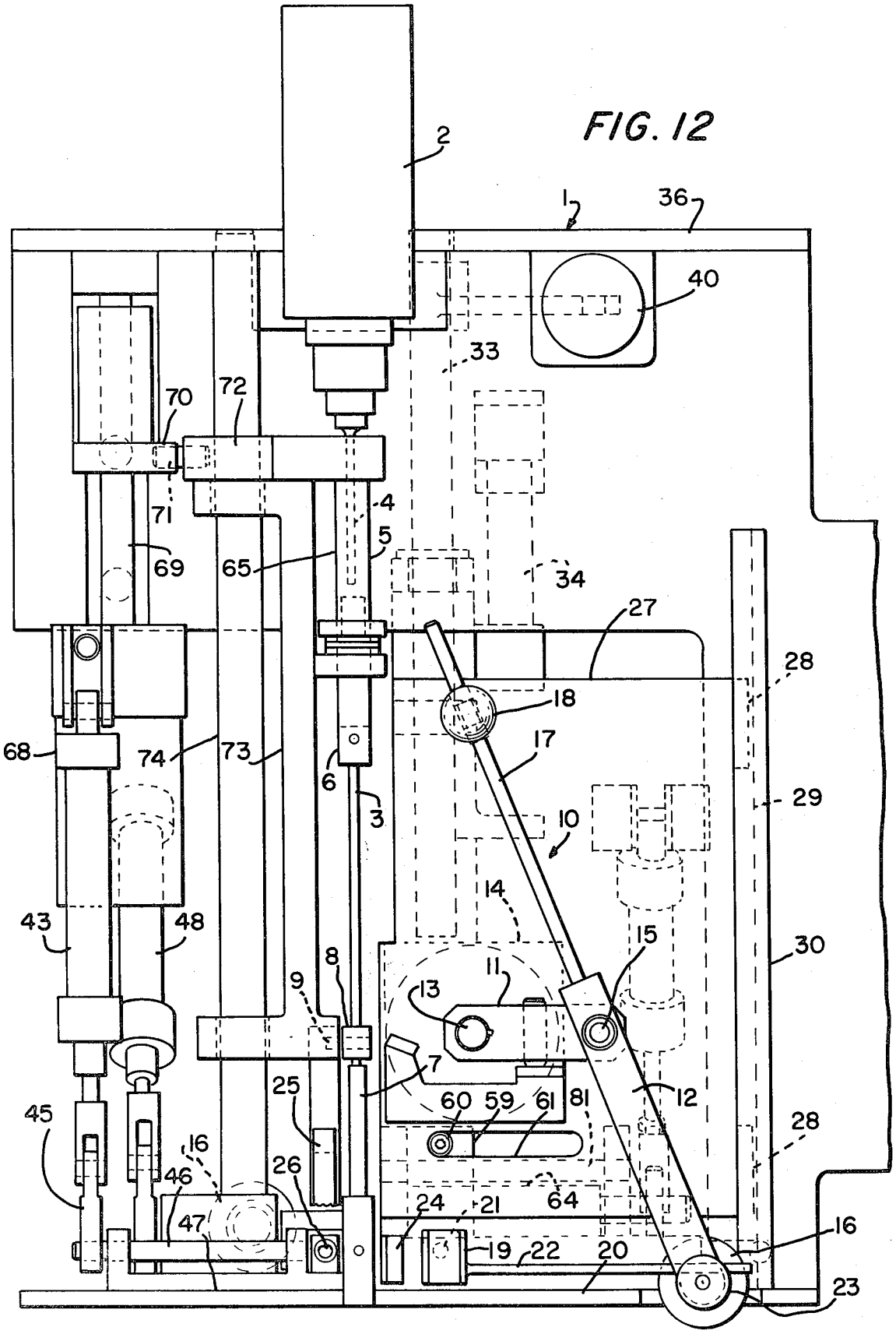
FIG. 12 is a front elevation view of the wire wrapping head showing the location of the various components.

Referring first to FIG. 12 for purposes of identification of various components of the preferred embodiment of this invention. A wire wrapping head according to this invention is shown generally as reference numeral 1. The wire wrapping head has mounted thereon a wrapping motor 2, which drives the wire wrapping bit 3 through a spline drive 4, bit drive shaft 5, and drive latch 6. The wire wrapping bit 3 is guided by bit holder 7 which, as will be explained later, is capable of supporting the wrapping bit in both the horizontal and vertical positions. The bit holder is provided with a bit latch assembly 8 which locks the bit against axial movement during transfer between the horizontal and vertical positions. It should be understood that the use of the terms "horizontal" and "vertical" refer to the position of the bit relative to the embodiment shown in FIGS. 12, 13, and 14, and is not intended as an absolute position; that is, horizontal refers to a position essentially parallel to the terminal board. The bit latch is guided from the horizontal to vertical position by means of an arc segment of the slide guide 9 (best seen on FIG. 16) as will be more fully described.

One of the unique features of the present invention is the facility for loading the wire wrapping bit in a horizontal position wherein the bit may be extended substantially from the bit holder 7 without the need for an excessive "Z" axis distance from the terminal board. After the wire has been cut, stripped, and loaded into the bit by retraction of the bit into the bit holder, the bit may then be rotated into the vertical position for rotary drive and wrapping of the wire on the terminal. The above apparatus and the following wire feed assembly form the essential apparatus for accomplishing the invention.

Referring to FIG. 12, the positioning function of the wire feed assembly 10 is performed by a mechanism which is comprised of drive link 11, which is mounted on the output shaft 13 of wire feed rotary motor 14. The drive link 11 is pivotally connected to pulley arm 12 by means of pivot 15. The pulley arm 12 has attached to its one end wire feed pulley 16. Extending from the other end of pulley arm 12 is a guide rod 17. The other end of guide rod 17 passes through a rotary slide bushing 18. It can be seen that as the drive link 11 is rotated counterclockwise approximately 170°, the linkage formed by drive link 11, pulley arm 12, guide rod 17, and rotary slide bushing 18 will cause the wire feed pulley 16 to move in an arcuate path from its position to the right of the bit holder 7 to a position to the left of bit holder 7 shown in phantom lines on FIG. 12. A cutter and gripper assembly 19 is mounted for rotation about an axis horizontal to base plate 20 of the wrapping head and extending perpendicular to the plane of the paper of the FIG. 12. The axis of rotation is designated by reference numeral 21. The cutter and gripper assembly is rotated by means of control arm 22 which is in contact with pulley arm 12 by means of a rotary slide guide 23 (best seen on FIG. 13). It may be thus seen that as pulley arm 12 and wire feed pulley 16 are translated from the position to the right (as shown on FIG. 12) to the position on the left that cutter and gripper assembly 19 will be rotated approximately 180° about its axis of rotation 21. The function of this will be described later. Other important parts of the wire processing apparatus include stripper assembly 24, finger clamp 25, bench pin 26, and a wire dereeling unit not shown. The remainder of the apparatus is primarily mounting, guide, and actuating means which allow the various wire handling components to perform their functions.

Only sufficient detail is provided so that one ordinarily skilled in the art may understand the structure and function of each of the components. In general, there are several ways of designing each of the actuating components, and it is not intended that only those means shown in the illustrated embodiment will adequately perform the intended purposes. Several alternatives will occur to the designer skilled in the art of machine and mechanism design. Those means chosen for the preferred embodiment are intended only as a guide and one acceptable way of accomplishing the intended function for purposes of the preferred embodiment.

A portion of the wire feed assembly including the wire feed rotary motor 14, drive link 11, pulley arm 12, guide rod 17, rotary slide bushing 18, and cutter and gripper assembly 19 are mounted on mounting plate 27 which in turn is mounted in the wrapping head for vertical movement. The mounting plate 27 is guided by guide bushings 28 which slide in a channel 29 of a vertical guide 30. Attached to and projecting rearwardly from the mounting plate 27 is a support flange 31 (best seen on FIG. 13). Support flange 31 is further attached at the other end to a "C" shaped bearing holder 32 which in turn is slidably disposed on a vertical guide rod 33. It thus can be seen by one skilled in the art that mounting plate 27 may be moved vertically but is limited in movement in the horizontal plane by the guide bushings 28 and the "C" shaped bearing holder 32.

Figure 13:
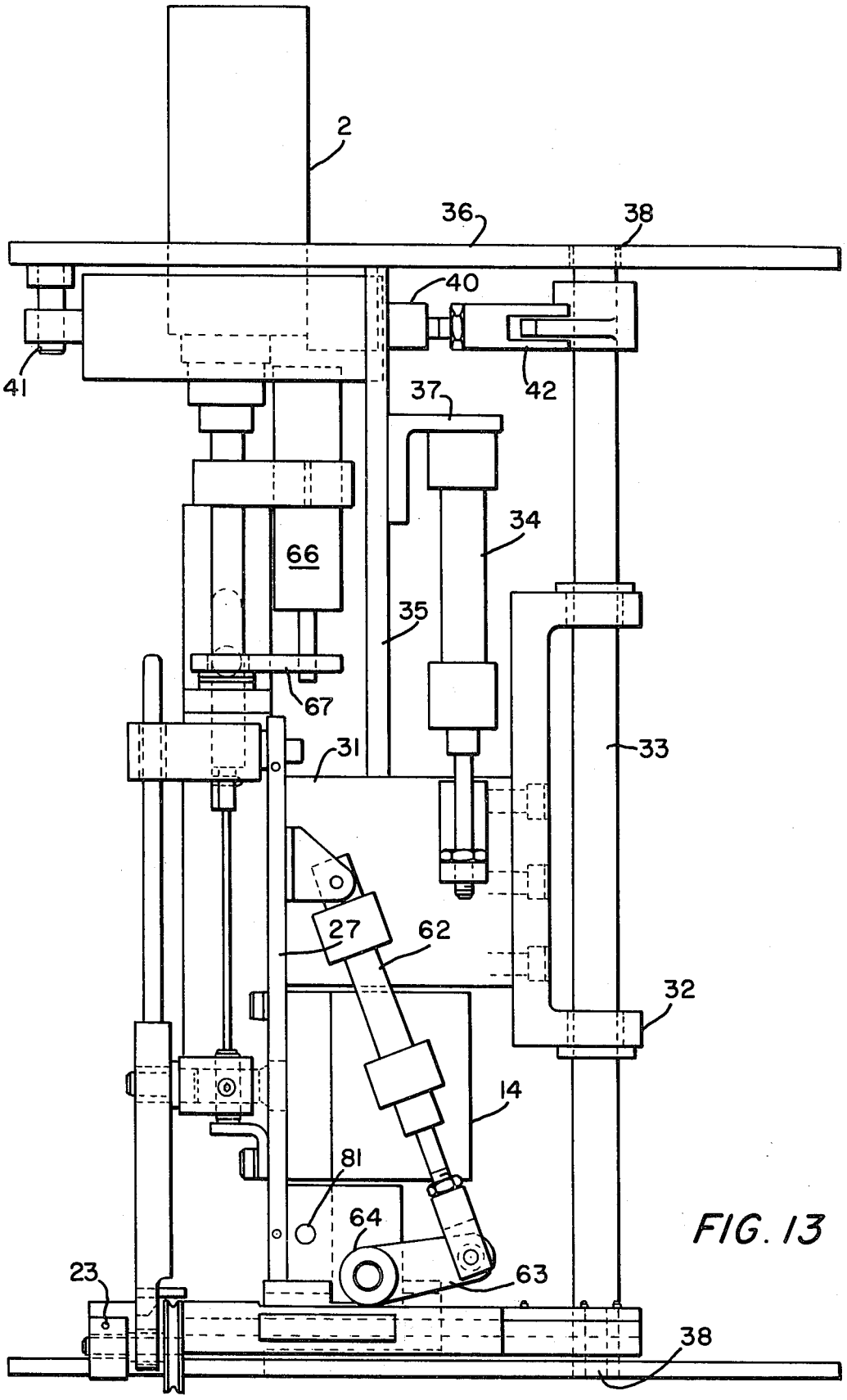
FIG. 13 is a right side elevation of the wire wrapping head showing the location of the various components.

A vertical drive cylinder 34, which in the preferred embodiment is an air cylinder, may best be seen on FIG. 13. One end of the vertical drive cylinder 34 is attached to structural member 35 which is fixedly attached to the top plate 36 of the wire wrapping head by means of an angle bracket 37. The rod end of the cylinder is adjustably attached to support flange 31. In this manner, the vertical movement of the mounting plate 27 may be adjusted and controlled by operation of the vertical drive cylinder 34. The vertical drive function will be described more fully under operation. The vertical guide rod 33 is mounted for rotation about its axis by means of bearings 38 at each end which are mounted in the top plate 36 and the base plate 39 of the wire wrapping head.

The vertical guide rod is rotated by means of stripper drive cylinder 40 which is mounted by pivot mount 41 to the top plate 36 at one end and adjustably attached to the vertical guide rod 33 by means of crank assembly 42. The operation of stripper drive cylinder 40, therefore, will cause vertical guide rod 33 to be rotated about its axis. Secured to the lower end of vertical guide rod 33 is the stripper assembly 24. When the stripper drive cylinder 40 is actuated, the stripper assembly is rotated about the axis of vertical guide rod 33. The operation will be more fully described later.

The finger clamp 25 is operated by means of clamp drive cylinder 43 which is pivotally mounted at one end to a support member 44 which is in turn mounted to one of the frame members of the wrapping head. The clamp drive cylinder 43 operates the finger clamp 25 through crank rod 45 and clamp mounting shaft 46. Clamp mounting shaft 46 is mounted for rotation about its axis in a shaft block 47 which is secured in turn to the base plate 20. It can be seen that when clamp drive cylinder 43 is actuated to extend, the cylinder rod will rotate crank rod 45 counterclockwise (see FIG. 14), and thereby also rotate clamp mounting shaft 46 and finger clamp 25. The finger clamp 25 will rotate until it comes in contact with bench pin 26.

As previously mentioned, bit holder 7 is mounted for rotation between the horizontal loading position and the vertical wrap position. Movement between the horizontal and vertical position is accomplished by means of bit drive cylinder 48 which is pivotally mounted at lug 49. The push rod 50 of bit drive cylinder 48 drives link 51 which in turn rotates bit shaft 52 which in turn rotates the bit holder 7 which is mounted on bit shaft 52. As shown on FIG. 14, actuation of the bit drive cylinder 48 to its extended position will cause link 51 to be driven clockwise which in turn will rotate bit shaft 52 clockwise and which in turn will drive the bit holder from the horizontal to the vertical position. Retraction of the bit drive cylinder will cause bit shaft 52 to be rotated counterclockwise (as viewed in FIG. 14) and thereby drive the bit holder 7 from the vertical to the horizontal position.

Wire wrapping bit 3 contacts drive latch 6 in the vertical position which allows the wrapping motor 2 to rotate the wire wrapping bit through a spline drive 4, a bit drive shaft 5, and the drive latch 6. When the bit holder is driven to its horizontal position, the bit is brought in contact with a shuttle block 53 which moves to the left and right (as shown on FIG. 14). The motion imparted to wire wrapping bit 3 by the shuttle block 53 is a reciprocating movement within bit holder 7. This allows the bit to be opened by movement to the right for loading and closed in sequential steps for wire capture and loading of the wire within the wrapping bit.

Shuttle block 53 also moves bench pin 26 to the left and right as required in the wire feed sequence. In addition, the shuttle block actuates the stripper assembly 24 by means of a pin 82 (see FIG. 19) in the stripper assembly 24 which contacts the shuttle block. The shuttle block 53 is slidably mounted on a shuttle block shaft 54 which is in turn fixedly mounted to base plate 20. The shuttle block 53 is driven to the right or left by means of shuttle block drive motor 55 which is attached by means of bracket 56 to one of the frame members.

Figure 14:
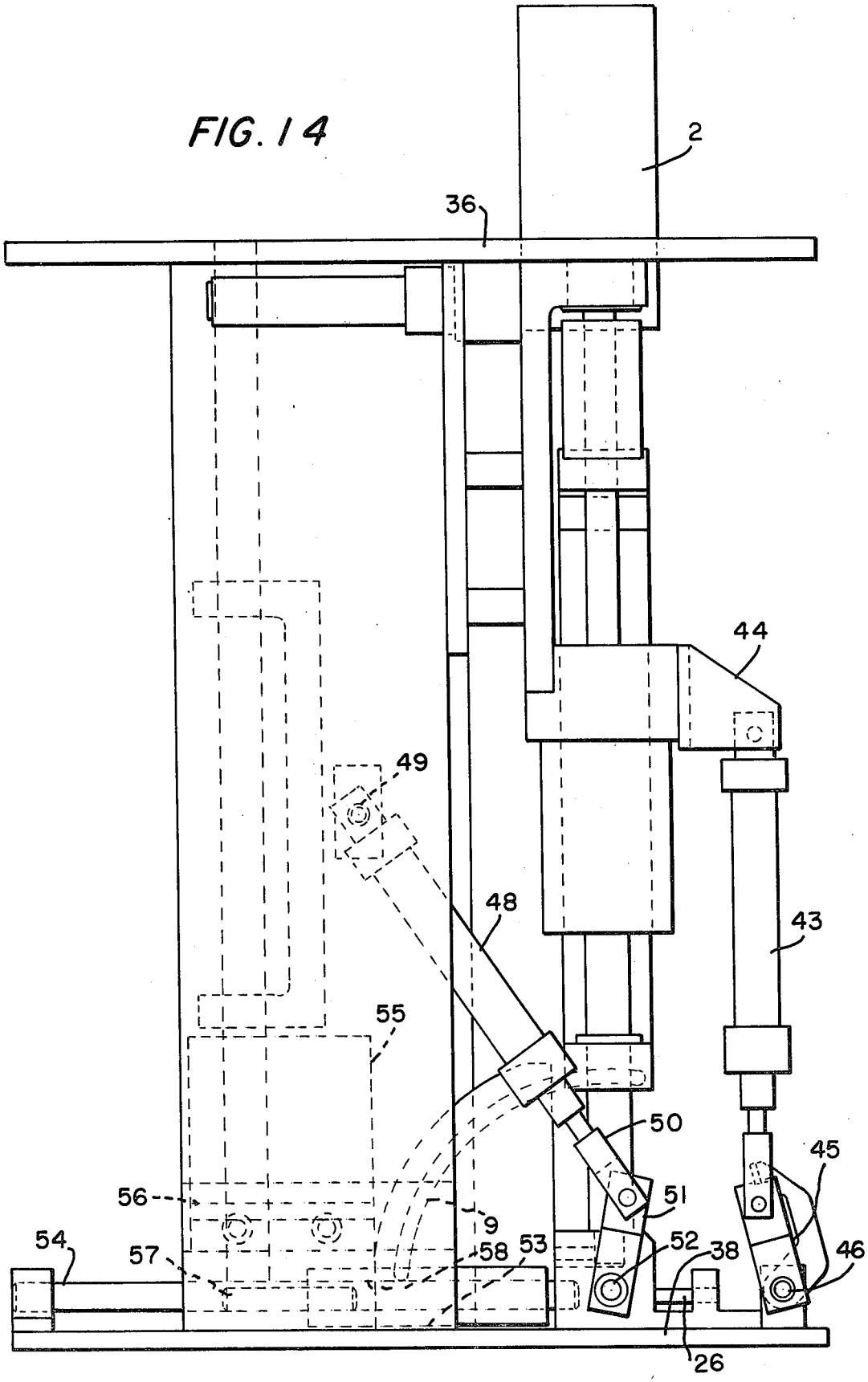
FIG. 14 is a left side elevation of the wire wrapping head showing the location of the various components.

The rotary output of the shuttle block drive motor 55 drives spur gear 57 which drives a rack gear 58 on shuttle block 53. Thus, rotation of the shuttle block drive motor will drive the shuttle block to the left or right (as shown in FIG. 14). As previously indicated, the movement of the shuttle block actuates the wire wrapping bit, the stripper jaws, and the bench pin.

The cutter and gripper assembly 19 is mounted for rotation about axis of rotation 21 (See FIG. 12). The cutter and gripper assembly is mounted on adjusting plate 59 which in turn is mounted on rod 81 which is fixed to mounting plate 27 by means of a clamp screw 60 which is accessible through slot 61 such that adjusting plate 59 may be moved to the right or left in mounting plate 27 and secured thereon. This adjustment allows for an increase or decrease of the length of the stripped end of the wire.

The cutter and the clamp of cutter and gripper assembly 19 are actuated by means of wire cutter and gripper drive cylinder 62. The operation of wire cutter and gripper drive cylinder will rotate clamp crank 63 which in turn will rotate wide faced gear 64 which is in contact with cutter and gripper assembly 19 and thereby drive the cutter and clamp open to receive the wire and closed to cut and clamp the wire. Wide faced gear 64 allows the motion to be imparted to the cutter and gripper assembly over the length of adjustment possible with adjusting plate 59.

The mounting of the bit drive with bit drive shaft 5 and spline drive 4 allows relative vertical movement between the bit and head. A constant force downward on the wire wrapping bit 3 is maintained by means of force spring 65. The construction allows the bit to move vertically upward during the course of the wrapping of a wire on a terminal. In the art of wire wrapping, it is well known that the success of a wire wrap is dependent on several features. As the wire is wrapped about the terminal in a vertically progressing spiral, a constant force downward of the appropriate magnitude to insure tightness of the wrap is an essential requirement. It is the purpose of force spring 65 to provide an essentially constant downward force while allowing the wire wrapping bit 3 to move vertically upward relative to the wrapping head during the course of a wire wrap.

In the present invention, the vertical movement of the bit is utilized to detect the height of wrap. A LVDT wrap height sensor 66 is provided for this purpose. Linkage 67 transfers the vertical movement of the bit during the wrap to the LVDT wrap height sensor, and in this manner the condition of the wrap may be checked. If no vertical height change is noted during the wrapping step, it is an indication of a bent or missing terminal board pin or other malfunction.

Vertical drive of the entire bit wrapping assembly is accomplished by means of stepping motor 68 which drives lead screw 69 which in turn causes ball nut 70 to be moved vertically up or down. Ball nut 70 is operatively connected by means of transfer pin 71 to slide bracket 72. Slide bracket 72 is secured to "Z" axis carriage 73. Both slide bracket 72 and "Z" axis carriage 73 are disposed on vertical guide shaft 74. It can be seen that as stepping motor 68 drives lead screw 69, the ball nut will advance downward or upward depending on the direction of rotation and either it drives slide bracket 72 downward or upward. This in turn moves the entire bit assembly downward or upward relative to the frame of the wire wrapping head. This allows the bit to be moved in the vertical direction downward to a position where it is disposed upon a terminal board pin for purposes of wire wrapping. The stepping motor drive also accomplishes the appropriate vertical level of wrap on the terminal board pin.

The above description generally describes and locates the various major components of the present invention. For a more complete description of the function of several of the various sub-assemblies, it is necessary to refer to the following detailed drawings:

FIG. 15 shows the details of construction of the wire wrapping bit and bit holder assembly.

Referring now to FIG. 15, the bit is made in four parts: a head 90, a shank 91 which has the loading notch 77 and a latch notch 92, a tubing extension 93, and wrapping tip 94. These parts are permanently assembled.

The bit assembly fits concentrically within a fixed outer sleeve or bit holder 7, which is anchored to the bit latch assembly 8. An "L" shaped latch 97 is held by spring pressure against latch notch 92 on the bit shank to prevent the bit from rotating or being thrown out by centrifugal force during transfer of the bit from horizontal to vertical and back. The latch notch 92 is ramped towards the head end, as can be seen in FIG. 15, to allow the bit to be driven axially to its loading position by the shuttle block. The ramp displaces latch 97 against its spring action by the force of the shuttle block 53 during the loading cycle.

The latch assembly 8, in turn, fits onto the bit holder assembly, which consists of a bit holder block 101 and two fixed guide pins 102. The bit holder 7 is slidingly disposed in a hole 103 in the bit holder block, while the guide pins 102 slide in guide bushings 104 in the latch assembly 96, constraining their relative movement to axial motion only.

In the wrapping head 1, the bit holder block 101 is fixed to the bit shaft 52 which transfers the bit between its vertical and horizontal positions. The axial position of the latch assembly and hence the bit relative to the bit holder is controlled by a latch guide fixed to the base. A guide lug 105 on the latch assembly 96 rides in an arcuate groove on the slide guide 9, thus maintaining the latch assembly and bit at a fixed radius during rotation from vertical to horizontal or the reverse.

Figure 16:
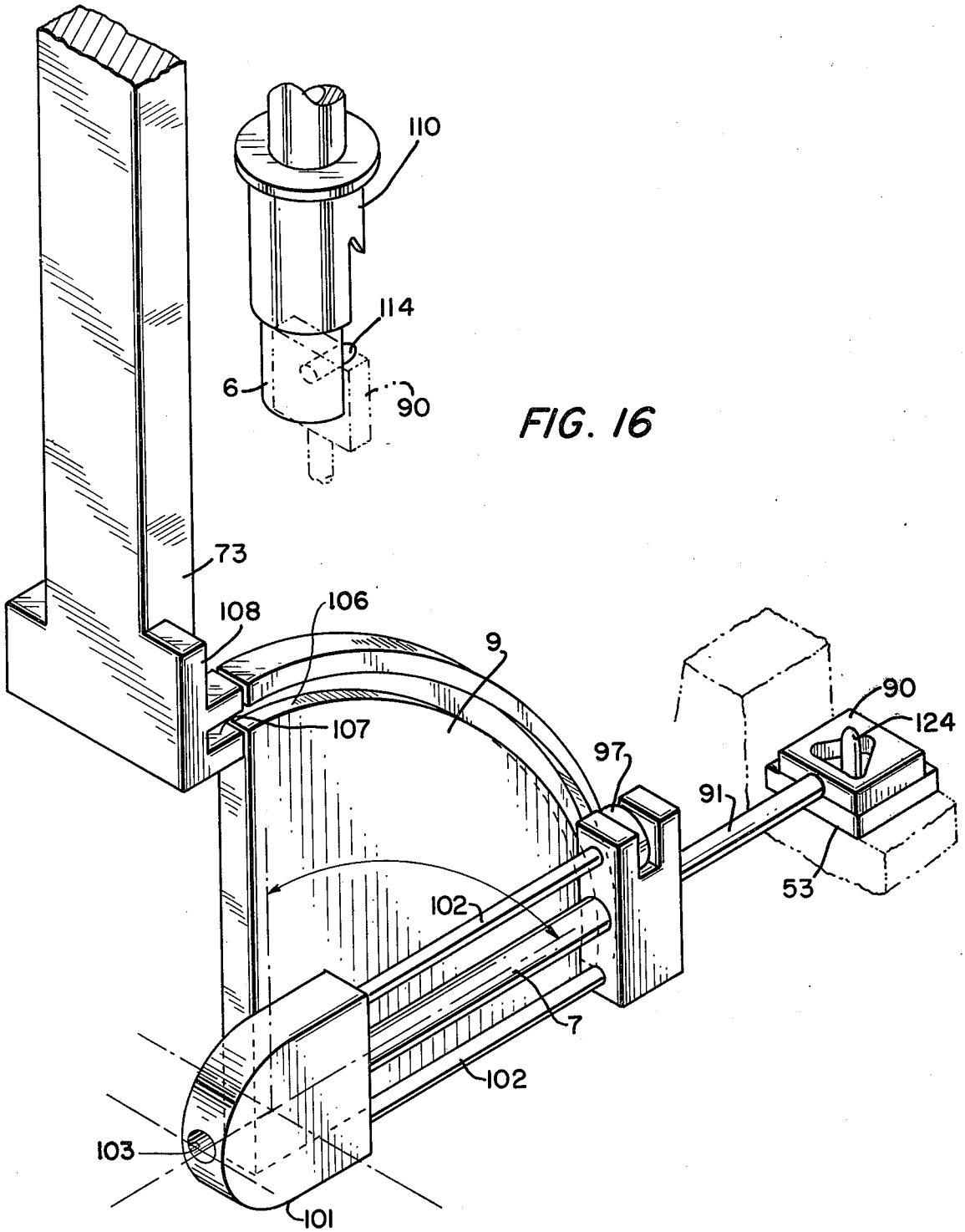
FIG. 16 is a perspective view of the wrapping bit, latch bit holder and latch guide showing the principal of rotating the bit holder and the wrapping bit cooperation with the shuttle block and the wrapping drive latch.

FIG. 16 shows the details of construction which facilitate rotation of the bit from the horizontal loading position to the vertical wrapping position.

Referring now to FIG. 16.

As the bit holder moves from horizontal to vertical, the guide lug 105 (see FIG. 15) leaves the fixed track 106 in the slide guide 9 and engages a slot 107 in an upper stop block 108 attached to the "Z" axis carriage 73.

Simultaneously, the bit head 90 engages a drive latch pin 114 on the bit drive latch 6, and the "L" shaped latch 97 is pushed back by contact with the upper stop block 108. This frees the bit to move axially relative to the latch assembly and outer sleeve or bit holder 7.

FIG. 17 shows the details of construction of the bit drive.

Figure 18:
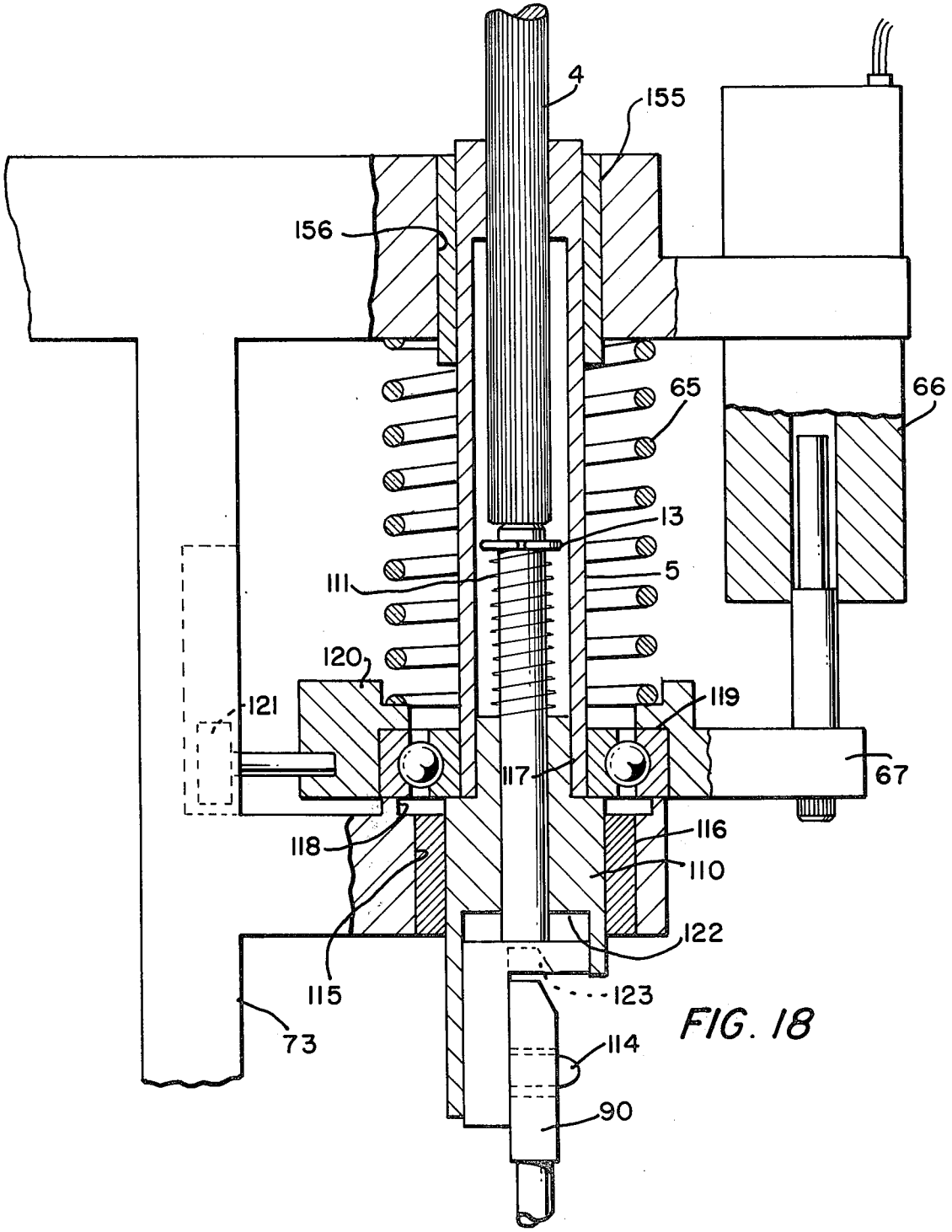
FIG. 18 is a sectional view of the bit drive assembly, the constant force "Z" axis carriage and "Z" level LVDT.

The bit drive consists of a drive shaft from the wrapping motor 2 having a spline end 4 which engages a bit drive shaft 5. A latch bearing 110 is inserted in the end of the bit drive shaft 5. The latch bearing retains the latch spring 111, within the bit drive shaft. The drive latch 6 slides within the latch bearing 110. A pilot pin 112 extends up through the center of the latch bearing and through the center of the latch spring 111 wherein it is retained by a snap ring 113. The drive latch 6 further has a bit head engaging pin 114. The assembly of the bit drive may be seen in FIG. 18. FIG. 18 shows the details of construction of the bit drive and constant force mechanism as well as the vertical wrap height sensing means.

Referring now to FIG. 18, the "Z" axis carriage 73 is provided with a bore in both its upper and lower extended arms. The lower bore is designated by reference numeral 115. The upper bore is designated by reference numeral 156. Disposed in each of the bores is a bushing. The lower bushing is designated as Bushing 116. The upper bushing is designated as bushing 155. The bit drive shaft 5 rotates in the upper bushing, and the latch bearing 110 rotates in the lower bushing. The latch bearing has a boss 117 which extends inside the bit drive shaft 5 and the collar 118 which acts as a thrust collar to prevent the latch bearing 110 from moving axially downward relative to lower bushing 116. Riding also on the thrust collar 118 is an inner race of the vertical height sensor bearing 119. Mounted on the outer race of the vertical height sensor bearing 119 is a rim 120. Rotation of the rim is prevented by means of anti-turn bearing 121. The rim 120 is in contact with the wrap height sensor 66 by means of a linkage 67. The rim 120 also contacts the constant force spring 65. Shown also in FIG. 18 is the bit head 90 disposed on engaging pin 114.

As the "Z" carriage moves downward to bring the wrapping bit in contact with the terminal, it carries with it the bit latch assembly 96 because of the contact of the upper stop lug with the guide lug 105. In addition, the latch bearing 110, the bit drive shaft 5, rim 120, and constant force spring 65 as well as the LVDT wrap height sensor 66 are carried down. The drive spline 4 remains fixed vertically. As can be seen from FIG. 18, during the initial movement downward, the drive latch and hence the bit head 90 remain stationary until latch spring 111 causes the drive latch 6 to be drawn into the latch bearing 110. This causes the head 90 of the bit to be drawn up until it bottoms in mating tapered slot 123 in the latch bearing 110. The mating tapered slot may best be seen in FIG. 17. The bit head 90 of the bit is correspondingly tapered. The result of this action is to align and secure the bit head to the latch bearing 110. It is held there by the force of latch spring 111.

As the "Z" axis carriage proceeds further downward, the bit head 90 and hence the remainder of the wrapping bit will be driven downward with the carriage and the outer sleeve or bit holder 7. The "Z" axis carriage assembly is lowered until the bit engages the terminal at the proper wrapping level. It is well to know at this point that the axial motion of the bit and drive assembly relative to the latch assembly 96 and the bit holder 7 is prevented only by the preload of the constant force spring 65. During the formation of the spiral wrap of the wire connection, the bit and hence the bit head, latch bearing, bit drive shaft, rim 120, linkage 67, and the core of the LVDT coil will be driven vertically upward against the constant force spring 65. In this manner, a constant force is exerted by the bit against the coils of wire as they are wrapped, and it is possible to measure or check the wrap height.

As the "Z" carriage is returned vertically upward after the wrap is completed, the action described above is reversed. The head of the bit is released from the latch bearing 110 only at the top of the "Z" axis carriage movement. The bit head latch is opened by contact with the end of the drive spline 4. When the bit latch is opened, the latch guide lug 105 is aligned with the arcuate segment of the slide guide 9. This frees the entire assembly allowing it to be rotated back to the horizontal position.

Referring again to FIG. 16, the bit assembly is shown in the horizontal position. The head of the bit 90 is shown in contact with the shuttle block 53 on reciprocal drive pin 124.

Figure 19:
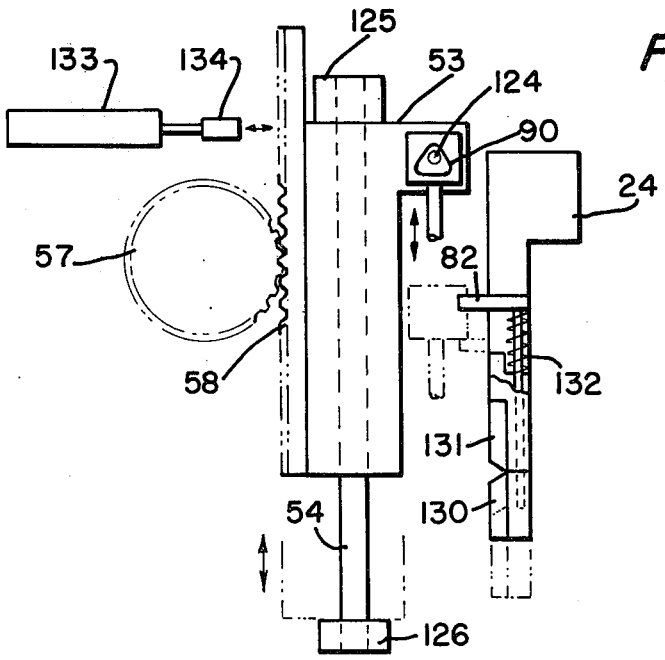
FIG. 19 is a plan schematic showing the shuttle block assembly and the stripper assembly.

FIG. 19 shows the details of the shuttle block assembly and stripper assembly. The shuttle block 53 is mounted on a shaft 54 which is secured to the wrapping head frame by means of rear support and stop block 125 and front support and stop block 126. Mounted on the shuttle block is a rack gear segment 58 which is driven by a spur gear 57 which in turn is driven by shuttle block drive motor 55. It can be seen that as spur gear 57 is rotated by the shuttle block drive motor 55, it will drive rack gear 58 causing the shuttle block to translate along the guide shaft 54.

The shuttle block 53 is provided with a reciprocal drive pin 124 which is in contact with and reciprocally drives bit head 90. The reciprocal motion imparted to the bit is utilized in the loading sequence for drawing the wire into the bit. In the schematic drawing of FIG. 19 when the shuttle block is driven all the way to the bottom of its travel so that it contacts front support and stop block 126, the wire wrapping bit 3 is fully extended in a position to receive the insulated wire for loading into the bit.

As can be seen in FIG. 19, the relationship of the shuttle block 53 with respect to stripper assembly 24 is such that an angle projection 128 contacts an actuating finger 82 on the stripper assembly. This is shown in dotted lines on FIG. 19. The movement imparted by actuating finger 82 causes the movable blade of the stripper 130 to be opened as shown in dotted lines for receiving the insulated wire. The stripper is also provided with a fixed blade 131 and a return spring 132 which closes the stripper when the shuttle block is returned toward the rear support and stop block 125.

As will be described later, the loading of the wrapping bit occurs in two stages. The first captures the wire in the unique bit notch 77 and the second step draws the wire fully within the wrapping bit between the wrapping tip 94 and the sleeve or bit holder 7. In order to accomplish the two step operation with positive positioning of the bit, capture stop cylinder 133 is provided. When the shuttle block is in its forward position against the front support and stop block 126, actuation of capture stop cylinder 133 will cause pawl 134 to move to the right as shown in FIG. 19 to a position shown in dotted lines which interferes with the full return of the shuttle block 53.

The shuttle block, however, can return partially allowing the bit to close sufficiently to reach the capture position and allow the stripper assembly to be closed by means of return spring 132. In this position, the wire may now be stripped without fear of loss of wire from the wrapping bit. After the wire has been stripped, pawl 134 may be retracted by capture stop cylinder 133, and the shuttle block may then be driven to the full rear position drawing with it the wrapping bit and thereby completing the loading of the wire in the wrapping bit. The motion of the shuttle block assembly is also used to drive bench pin 26 into and out of the plane of the wire. This is accomplished by a simple lost motion device which is not shown. The lost motion device allows the bench pin 26 to be in place for operation of the finger clamp 25 when the shuttle block is in the full forward and capture positions and retracted only when the shuttle block is to the full rear position. Actuation of the bench pin may, of course, be by separate air cylinder, but we have found it convenient to utilize the shuttle block motion in the preferred embodiment.

Figure 20:
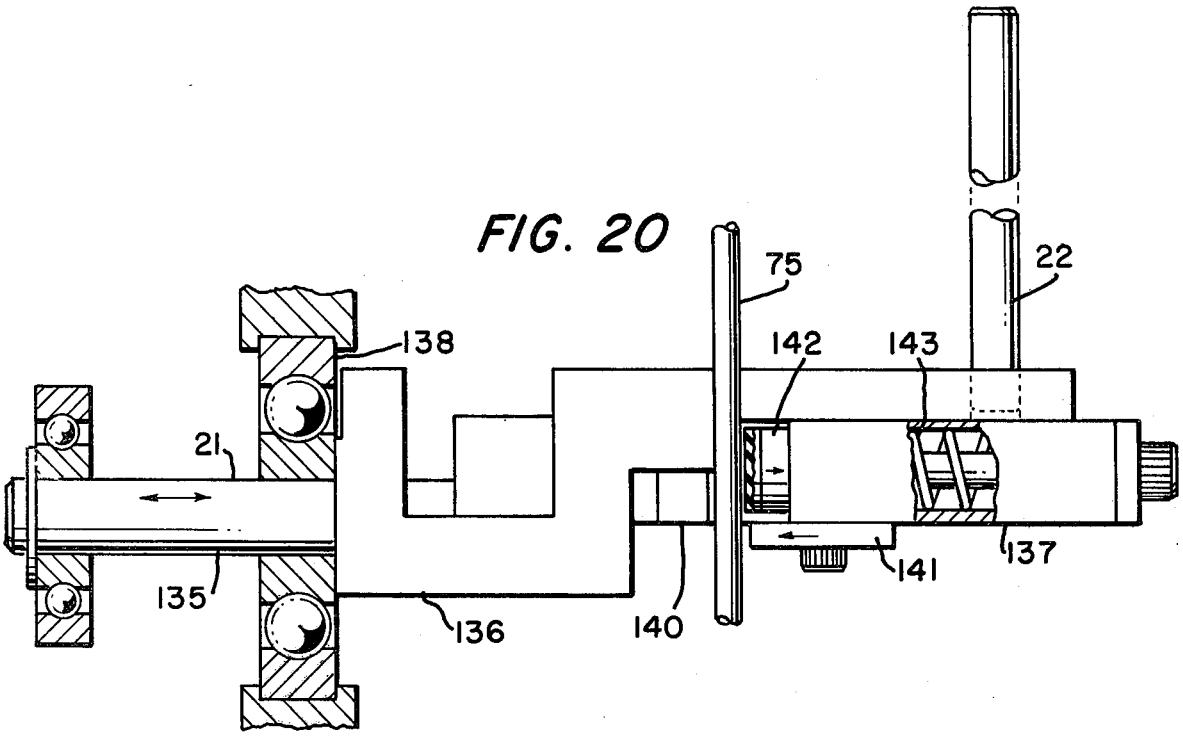
FIG. 20 is a plan schematic of the cutter and gripper assembly.

FIG. 20 is a schematic detail of the cutter and gripper assembly 19. The cutter and gripper assembly is comprised of a cutter actuating shaft 135. A cutter body 136 is rotatively mounted on cutter actuating shaft 135. Mounted on cutter body 136 is a movable cutter and gripper block 137. The movable cutter and gripper block is fixedly secured to the cutter actuating shaft. The cutter actuating shaft is also free to slide axially in cutter body 136 as well as rotating. In addition, cutter actuating shaft 135 is free to move axially in its mounting bearing 138. A back mounting bearing allows the cutter actuating shaft 135 to rotate but transmits the axial force generated by wire cutter and gripper drive cylinder 62 through clamp crank 63, wide faced gear 64, and a rack segment (not shown).

As can be seen by one skilled in the art, the entire cutter and gripper assembly is free to rotate, however, the cutter actuating shaft may be translated axially to impart an axial movement to the movable cutter and gripper block 137 relative to the cutter body 136. The cutter body 136 is provided with a body cutting blade 140. The movable cutter and gripper block 137 is provided with block cutting blade 141. Since the movable cutter and gripper block 137 is fixedly secured to the cutter actuating shaft 135, and is mounted on cutter body 136 so that it cannot rotate relative to cutter body 136, it can be seen that movement of the cutter actuating shaft axially will move the movable cutter and gripper block 137 axially relative to the cutter body 136. In doing so, the cooperation of body cutting blade 140 and block cutting blade 141 will shear the wire 75.

The movable cutter and gripper block 137 is also provided with a spring loaded gripper plunger 142 which will securely grip the wire against gripper surface 143 of the cutter body 136. Force in the spring loaded gripper plunger 142 is maintained by plunger spring 144. Damage to the wire is prevented by use of a resilient pad 145 mounted on the plunger tip.

It can also be seen that the entire cutter and gripper assembly is free to rotate about axis of rotation 21, and the rotation of the assembly is accomplished by means of control arm 22, which is fixedly secured to cutter body 136 and slidably disposed on its other end in a slide bushing mounted on the shaft of wire feed pulley 16. The overall action of the cutter and gripper assembly and its unique rollover function in the wire handling sequence of my invention will best be understood by reference to the description under the sequence of operation.

Figure 21:
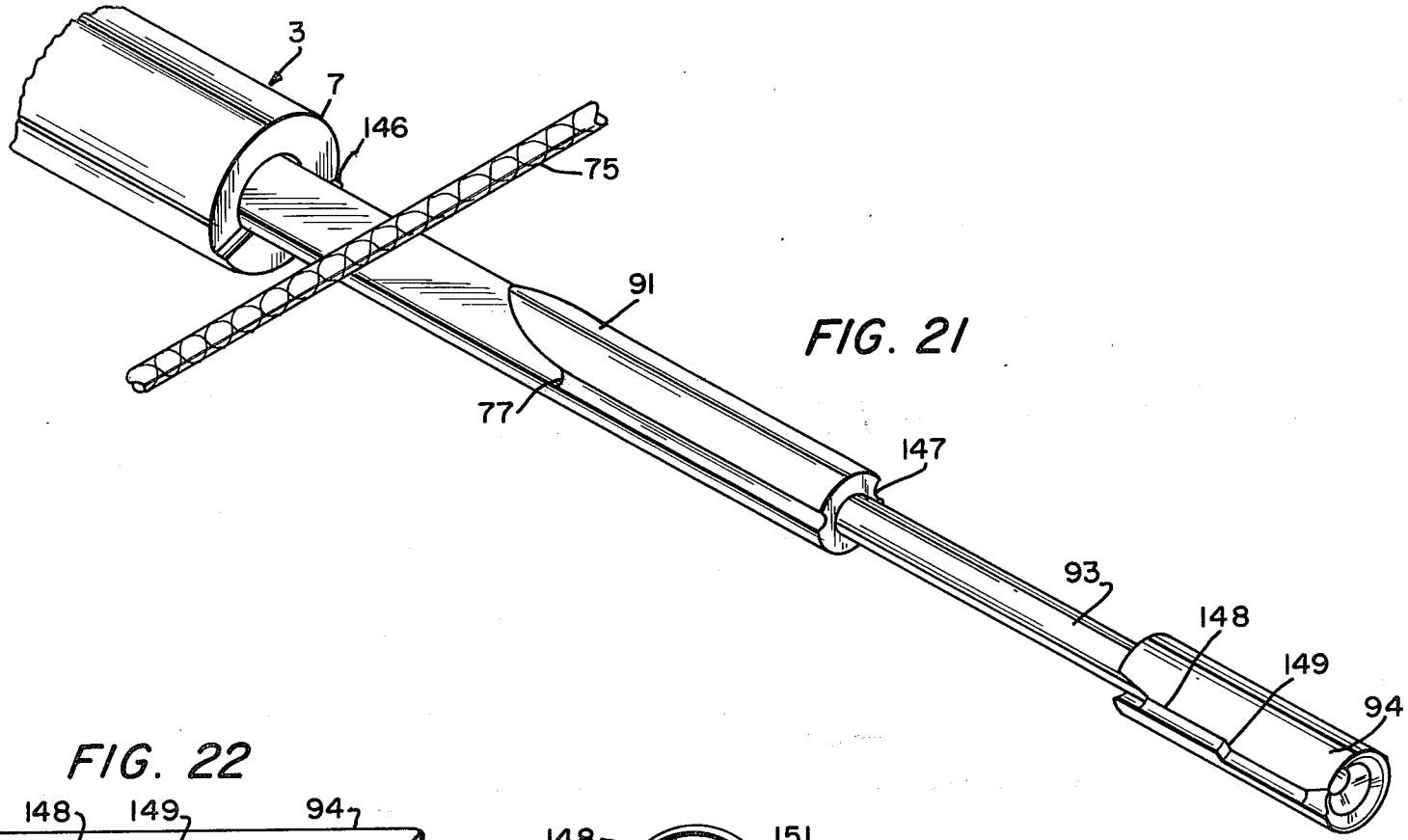
FIG. 21 is a schematic view of the end of the wire wrapping bit showing it in its fully extended wire receiving position.

FIG. 21 shows the wire wrapping bit in its fully extended position for receiving the wire. The wire wrapping bit, generally designated by the reference numeral 3, is comprised of four main sections: a bit holder or outer sleeve 7, a shank 91, a tubing extension 93, and the wrapping tip 94. The bit holder 7 is essentially a hollow tubular member which slidingly retains the bit and also serves to retain the captured wire in cooperation with the shank and the wrapping tip. To facilitate this, the end of the bit holder which receives the wire is smoothly radiused to prevent wire damage. The end of the bit holder 7 is also provided with a wire stop 146 which prevents the insulated portion of the wire from wrapping about the terminal post during the wrapping operation.

The shank 91 is provided with a notch 77 which, as will be described more fully later, is utilized to capture the wire during the stripping operation. The shank is also provided with two axial channels 147 which allow the wire to run axially in the bit between the shank 91 and the bit holder 7 during the initial phases of wire loading. The notch is generously radiused between the two axial channels to prevent wire damage as the wire is substantially bent into the bit holder 7 while loading.

The tubing extension 93 is merely a reduced section of the shank which makes up for the various stripped length of wire required in normal wire wrapping practice. The remaining portion of the wrapping bit is wrapping tip 94. The wrapping tip contains an unique wire control slot 148. The discontinuity 149 in the wire control slot has been found to be extremely valuable in the control of the wire during the final phase of wire loading and "Z" axis travel to the terminal to be wrapped. The discontinuity provides a means for positive control of the wire during this phase.

Figure 22:
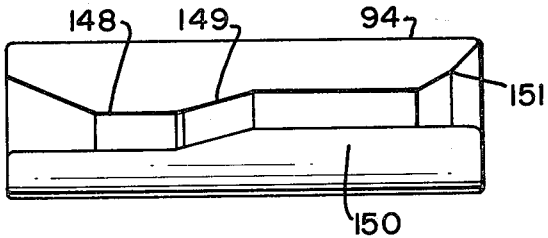
FIG. 22 is a detailed side view of the tip of the wire wrapping bit showing the wire control slot.

FIG. 22 shows the wire control slot in greater detail. It also shows in dotted lines the terminal receiving cavity 150 which is essentially an axial bore in the wrapping tip.

Figure 23:
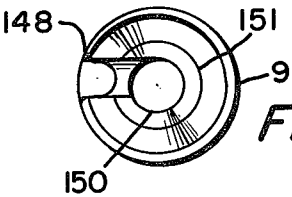
FIG. 23 is an end view of the wire wrapping tip.

FIG. 23 shows the details of the end of the wire wrapping tip. The configuration is generally similar to that in current wire wrapper use except for the wire control slot 148 and the compound cone inlet. The cone-shaped inlet 151 to the terminal receiving cavity forms the helical spiral of the wrapped wire by camming the wire around the terminal and down on the proceeding loop. The compound cone of approximately 30° and 45° as shown on FIG. 22 has been found to improve the quality of the wire wrap. The area between the terminal receiving cavity 150 and the wire control slot 148 is generously radiused to prevent wire damage during the wrapping cycle.

Figure 24:
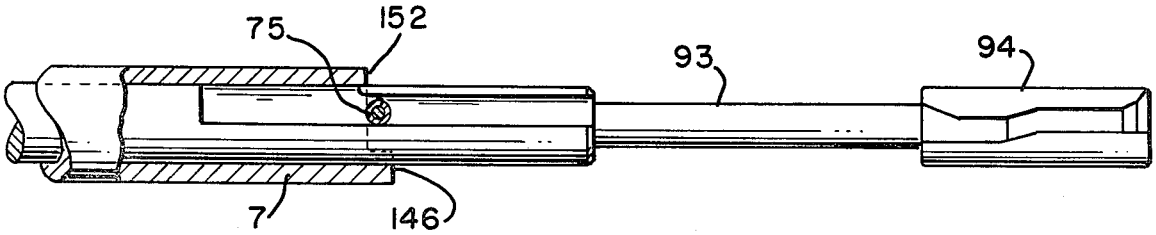
FIG. 24 is a partially sectioned side view of the wire wrapping bit in its wire capture position.

FIG. 24 shows the wrapping bit in its capture position. The upper lip 152 of the notch 77 is shown contacting the bit holder 7 and encircling the wire 75. This is the position of the wire wrapping bit during the wire cutting and the stripping cycle. The notch provides positive control of the wire during this phase.

Figure 25:
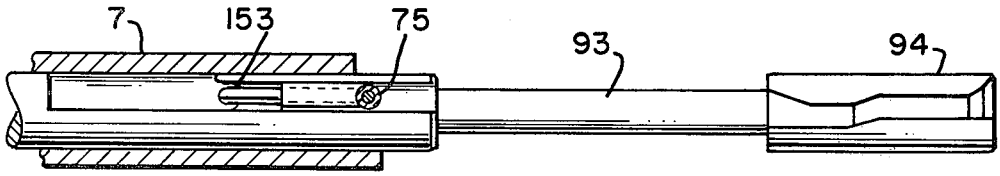
FIG. 25 is a partially sectioned side view of the wire wrapping bit showing the operation of the bit during the start of the loading sequence.

FIG. 25 shows the initial loading of the wire into the wrapping bit. As can be seen from FIG. 25, a portion of the insulated wire is loaded along with the stripped end of the wire 153.

Figure 26:
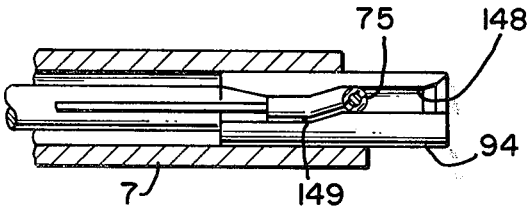
FIG. 26 is a partially sectioned side view of the bit showing the loading of the wire into the wire control slot at the tip of the bit.
Figure 27:
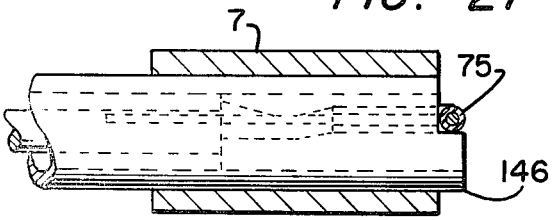
FIG. 27 is a side view of the bit showing the wire fully loaded and the bit ready for insertion on the terminal to be wrapped.

FIG. 26 shows the wire 75 as it is almost fully loaded within the wrapping bit. At this point, the wrapping tip 94 has entered the bit holder 7 and the wire is shown being drawn through the wire control slot 148. The discontinuity 149 causes the wire to be deformed slightly as it passes through the slot. It is this deformation that retains the wire in the wire control slot when the wire is fully loaded as shown in FIG. 27. The wire is shown in FIG. 27 abutting the wire stop 146. The wire is now ready for wrapping on the wire terminal of the terminal board.

Figure 1:
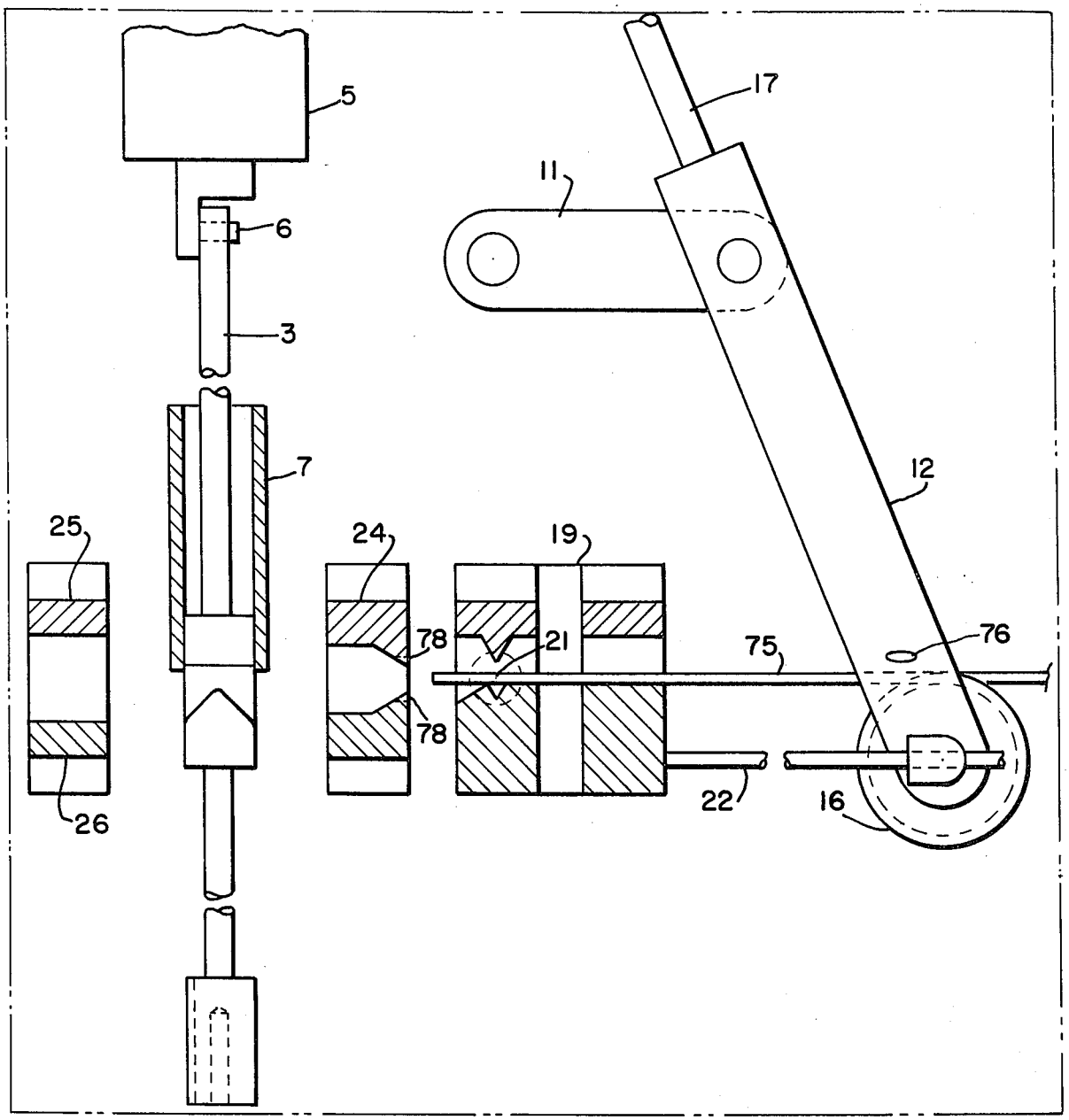
FIGS. 1 through 11 are schematic representations showing the major components of the wire handling system in sequence of operation for one complete wire wrapping cycle for both ends of the wire.

Turning now to the operation of the wire wrapper:

FIGS. 1 through 11 show the sequence of operation of the wire wrapper and the steps required to accomplish the unique method of this invention. FIG. 1 schematically shows the location of various components at the start of the wire wrapping sequence. In the pictorial representation, it should be understood that the position of the various elements is depicted only for purpose of describing the operating sequence. In particular, the finger clamp 25 is shown as the cross hatched block spaced a distance from the bench pin 26 also shown as a cross hatched block in FIG. 1. In the apparatus of the preferred embodiment, when the finger clamp is open as pictorially represented in FIG. 1, the finger clamp is rotated clockwise when viewed from the left of FIG. 1, out of the plane of the wire feed pulley thereby allowing the pulley arm 12 and the wire feed pulley 16 to pass by the clamp when it is in the opened position. Bench pin 26 is also capable of moving along an axis perpendicular to the plane of the paper and away from the viewer to allow the passage of the pulley arm 12.

During the sequence of wire stripping and loading, the wire wrapping bit 3 and bit holder 7 are rotated 90° counterclockwise when viewed from the right-hand side of the drawing from the position shown. The pictorial representation merely shows the relative extension of the bit during the loading sequence. It is impractical to show this extension with the bit in its horizontal loading position in the pictorial. Likewise, stripper assembly 24 and wire cutter and gripper assembly 19 are shown in a position rotated 90 clockwise when viewed from the right from their actual loading position. It should be understood that all wire entry to the finger clamp, wrapping bit, stripper and cutter and gripper assembly is from the top of the various assemblies in FIG. 1.

FIG. 1 represents the position of the various components relative to their opened and closed position for the start of the wire wrapping cycle. An electrical wire 75 of the common strippable, resilient insulation type is fed to the wire wrapping head from a wire dereeling unit (not shown). The wire dereeler is capable of feeding the wire continuously to the wire wrapping head at a relatively constant tension. The first step in operation of the wire wrapping head is to hand feed the wire over the wire feed pulley 16 between wire guide 76 and a groove in the wire feed pulley 16. The wire is also placed in wire cutter and gripper assembly 19. When this has been accomplished, the control system for the unit is actuated to initiate the start of the wire handling and wrapping sequence.

It should be understood that any suitable stepping drive control may be used to sequence the functions of the wrapping head. In the preferred embodiment, a tape drive unit has been utilized along with a commercially available X-Y positioning table for accurately moving the wrapping head from pin location to pin location. The methods for accomplishing tape drive sequence functions is well known in the tool control art and will not be described in detail here.

Figure 2:
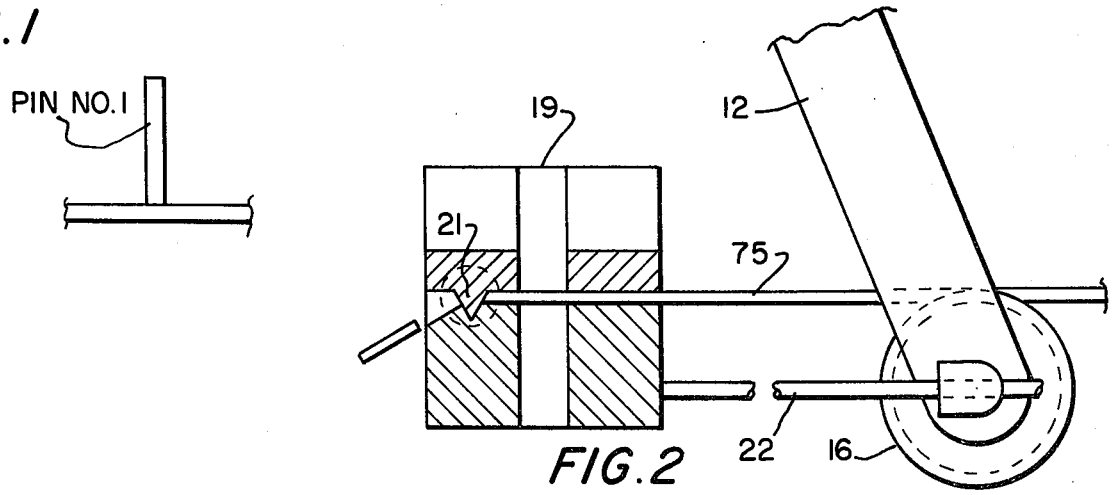
Figure 3:
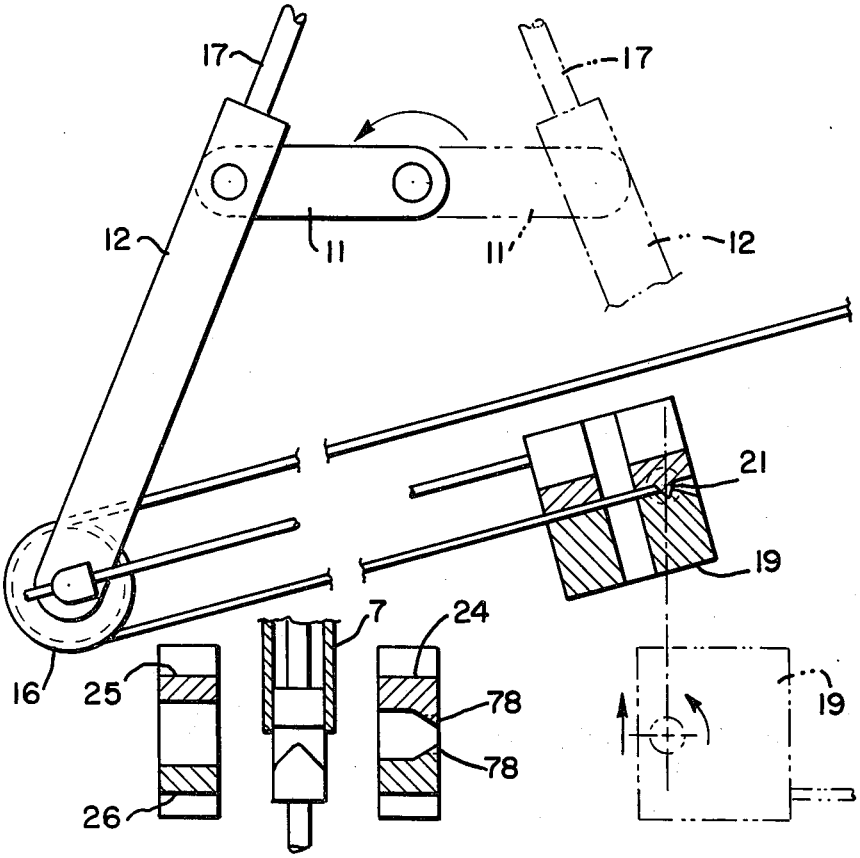

Returning now to FIG. 1, at the start of the initial loading sequence, the vertical drive cylinder 34 is activated which raises the wire feed assembly mounted on mounting plate 27 including the wire feed rotary motor, pulley arm 12, and the wire feed pulley as well as cutter and gripper assembly 19. Once the wire has been placed in the cutter and gripper assembly, the wire cutter and gripper drive cylinder 62 is actuated causing the wire cutter and gripper assembly to close resulting in the shearing of the excess wire end and the clamping of the wire in the cutter and gripper assembly as shown in FIG. 2. As shown in FIGS. 1 and 2, during the initial sequence, the pulley arm and wire feed pulley are to the right of the wire wrapping bit 3. Once the wire has been cut and captured in cutter and gripper assembly 19, the wire feed rotary motor is then actuated causing drive link 11 to be rotated counterclockwise as shown in FIG. 3. This results in the traverse of the wire feed pulley from right to left in an arc path as determined by the linkage formed by drive link 11, pulley arm 12, guide rod 17, and rotary slide bushing 18.

In moving from right to left, the pulley arm 12 causes the cutter and gripper assembly through control arm 22 to be rotated about axis of rotation 21 approximately 180°. As shown in FIG. 3, the pulley arm ends up to the left of wire wrapping bit 3 and wire cutter and gripper assembly 19 has rolled over. This completes the initial loading sequence.

Figure 4:
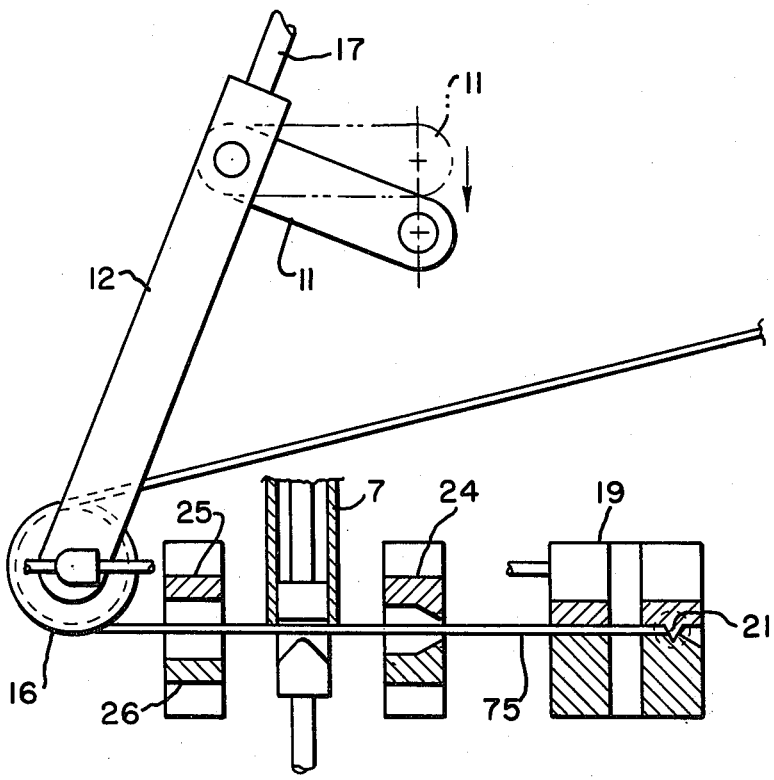

The normal operating sequence is as follows:

The vertical drive cylinder 34 is reversed to drive the mounting plate to its down position including cutter and gripper assembly 19. It should be mentioned here that in both the left and right-hand position, the wire feed pulley is driven against a stop by the wire feed rotary motor and is thus accurately positioned at either end of the traverse. The wire feed rotary motor is of the constant force type and thus as the mounting plate 27 is lowered, it is capable of accepting some clockwise rotation while still applying a counterclockwise force. The initial position of drive link 11 is shown in phantom on FIG. 4. The solid line shows the linkage and various assemblies after the mounting plate has been lowered. The lowering of the mounting plate including cutter and gripper assembly causes the wire stretched between the wire feed pulley 16 and the cutter and gripper assembly 19 to be disposed in position to be clamped by finger clamp 25, captured by wire wrapping bit 3, and contacted by stripper 24. All of these devices are located in line with each other as shown in FIG. 4.

Figure 5:
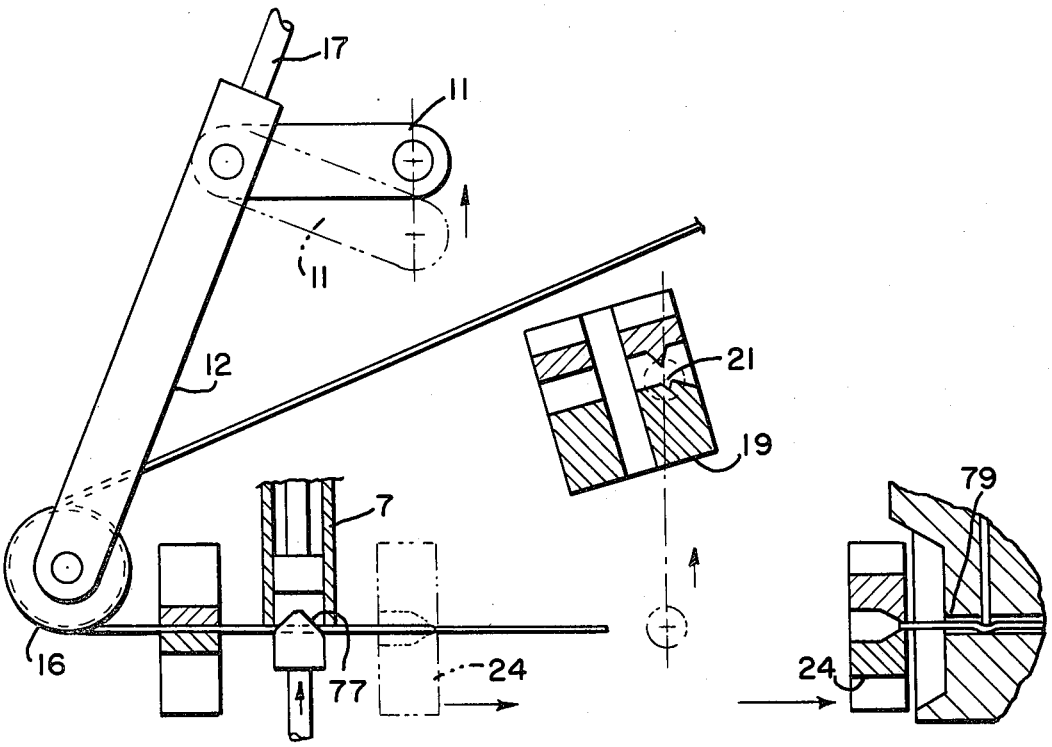
Figure 5A:
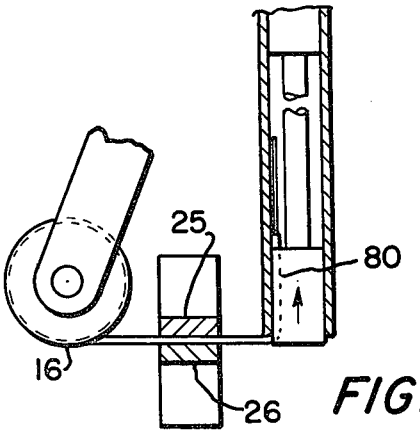

FIG. 5 shows the following sequential steps. Finger clamp 25 has been closed by actuation of the clamp drive cylinder 43. The wire has been captured in a notch 77 formed in the wire wrapping bit 3, the wire being held in the notch by the bit holder 7. Movement of the wire wrapping bit 3 is accomplished by driving shuttle block 53 to the left as shown in FIG. 14. This motion also closes the stripper assembly 24 about the wire. The stripper jaws 78 surround the wire and cut the insulation, but not the wire. At this point, it can be seen that the wire is now securely held by finger clamp 25, captured in the bit 3 and bit holder 7, and enclosed in the stripper jaws 78. Wire cutter and gripper drive cylinder 62 is then actuated to open the cutter and gripper assembly 19. Vertical drive cylinder 34 is again activated to raise mounting plate 27 to its top position thereby also raising cutter and gripper assembly 19.

Once cutter and gripper assembly 19 has been raised, the stripper drive cylinder 40 is actuated to rotate vertical guide rod 33 counterclockwise when viewed from the top (see FIG. 13). As vertical guide rod 33 is rotated, stripper assembly 24 is rotated counterclockwise along with the vertical guide rod 33. This results in the end of the stripper assembly away from the vertical guide rod moving to the right as shown in FIG. 5 in an arcuate path about the center of the vertical guide rod to a position to the right of the cutter and gripper assembly. As the stripper jaws 78 move to the right, they carry with them the wire insulation leaving the now stripped wire ready for loading into the bit. The insulation carried by the stripper jaws is disposed in a stripped insulation receiving port 79 where it is picked up by vacuum and subsequently transferred to a receiving bin.

Following the stripping of the wire, the wire wrapping bit 3 is fully retracted into the bit holder 7 drawing with it the stripped end of the wire. This is accomplished by driving the shuttle block to the left as viewed in FIG. 14. Shuttle block 53 being in contact with driving bit 3 also drives it to the left. The wire is fed into the bit holder 7 by the bit notch 77 and retained therein by a wire control slot 148 in the wrapping end of the bit. The details of the wrapping bit is described elsewhere in greater detail. However, at this point, it is useful to repeat that the wire control slot 148 is provided with a discontinuity 149 to aid in retaining of the wire within the groove. The wrapping bit is now loaded and ready to wrap the first terminal in the wire connection. Finger clamp 25 is now rotated clockwise when viewed from the left to release the wire, and bench pin 26 is retracted by a spring which was compressed by forward motion of the shuttle block.

Figure 6:
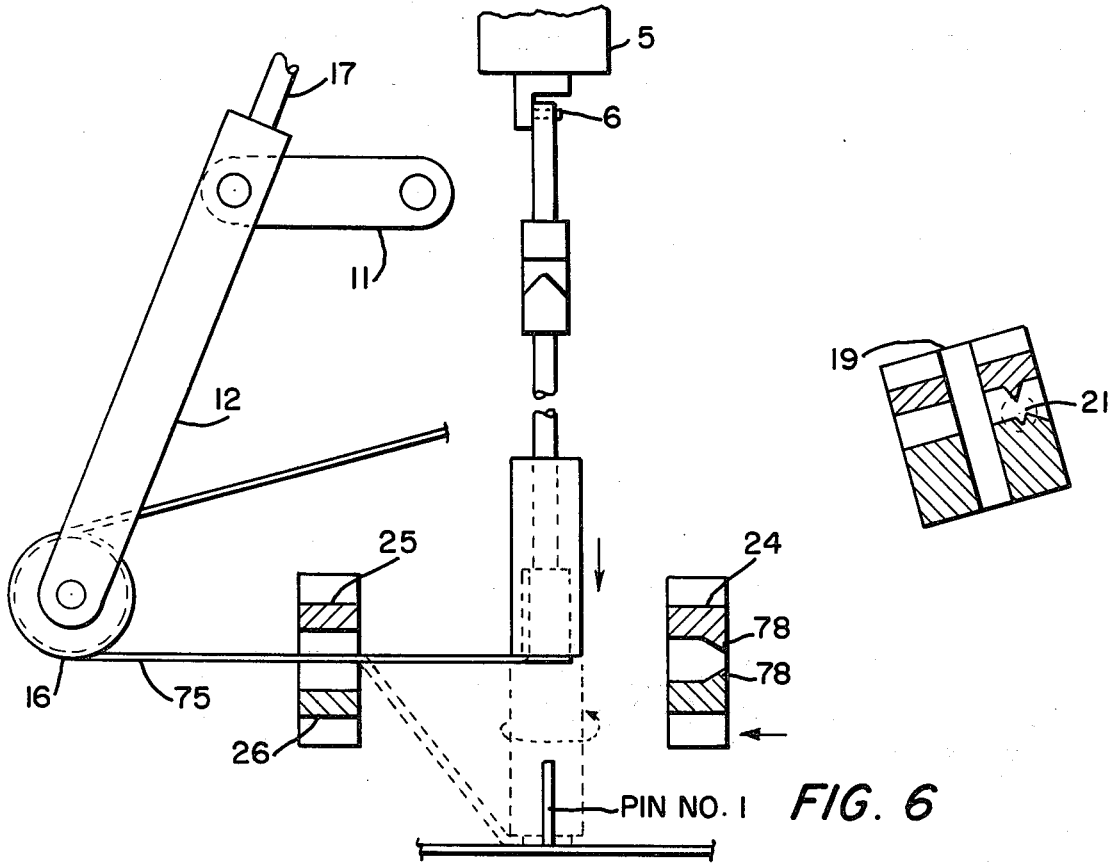

The bit holder and bit are now rotated 90° clockwise when viewed from the right to the vertical position shown in FIG. 6. This is accomplished by actuating bit drive cylinder 48 though link 51 and bit shaft 52. The bit is guided to the vertical position by means of a slide guide 9. As the bit is brought to the vertical position, the top of the bit is brought in contact with drive latch 6 which has been discussed more fully above. At this point, the bit has been positioned over the first terminal. The stepping motor or positioning drive means 68 is now actuated for a controlled amount of rotation driving ball nut 70 downward, as viewed in FIG. 12, and along with it slide bracket 72, "Z" axis carriage 73, bit drive shaft 5, drive latch 6, and the wire wrapping bit 3 and bit holder 7 until the bit and bit holder are positioned as shown in FIG. 6 in dotted lines over the terminal pin.

Figure 7:
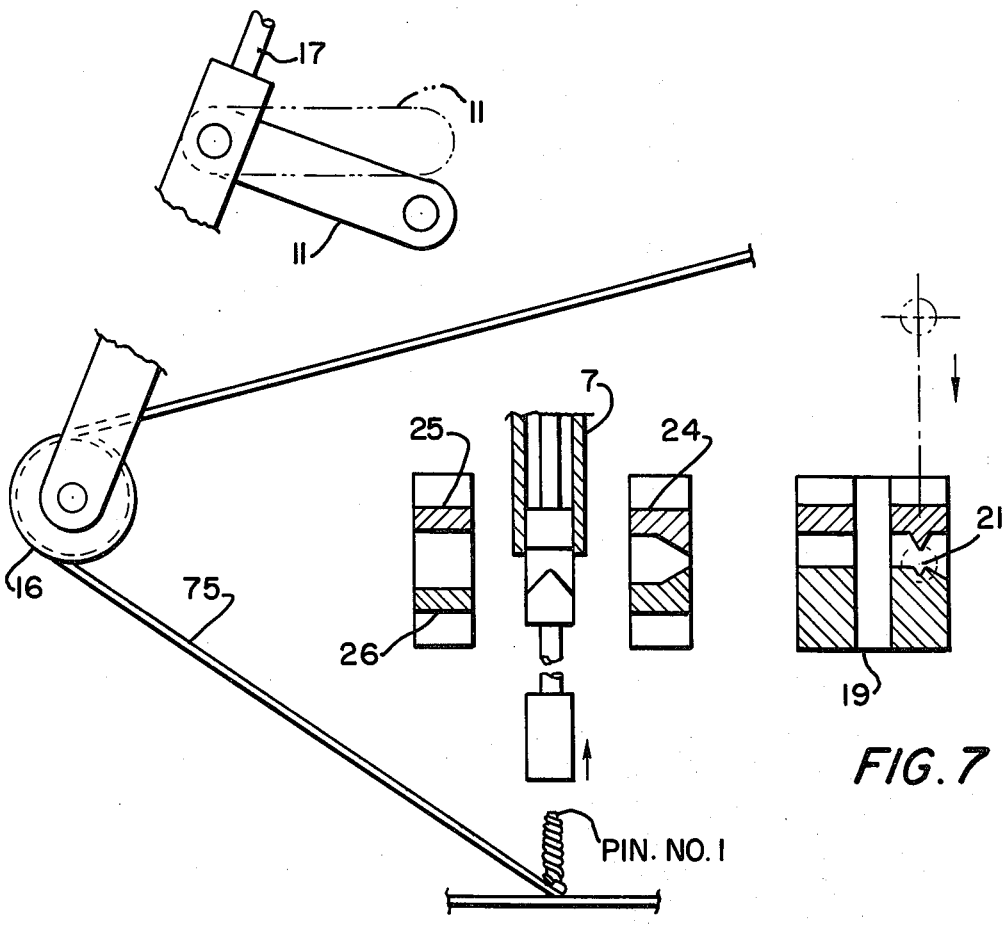

At this point, wrapping motor 2 is actuated to rotate the spline drive 4, bit drive shaft 5, and the wire wrapping bit 3, in a clockwise direction when viewed from the top. This produces a spiral wrap on the pin as shown in FIG. 7. As the wrap progresses upwardly, the wire wrapping bit 3 is forced upwardly against force spring 65. As previously mentioned, the vertical movement is measured by an LVDT wrap height sensor 66, and if the wrap is proper and progresses for the appropriate height, a good wrap signal is produced. This signals the apparatus to proceed to the second end of the wrap.

At any point after the wire has been drawn into the wire wrapping bit 3, the stripper assembly 24 may be returned to the original position shown in FIG. 1. Bit holder 7 and wire wrapping bit 3 are then retracted from pin 1 by means of the stepping motor 68 as previously described for the downward movement. This is shown in FIG. 7. In addition, the mounting plate 27 is again driven downward to position the cutter and gripper assembly 19 in line with the wrapping bit 3 and the clamp and stripper assembly. The wrapping bit is driven to its horizontal position again by bit drive cylinder 48 and the wrapping bit is extended to its loading position by means of the shuttle block 47 as previously described, and in addition, bench pin 26 is also moved to its extended position.

Figure 8:
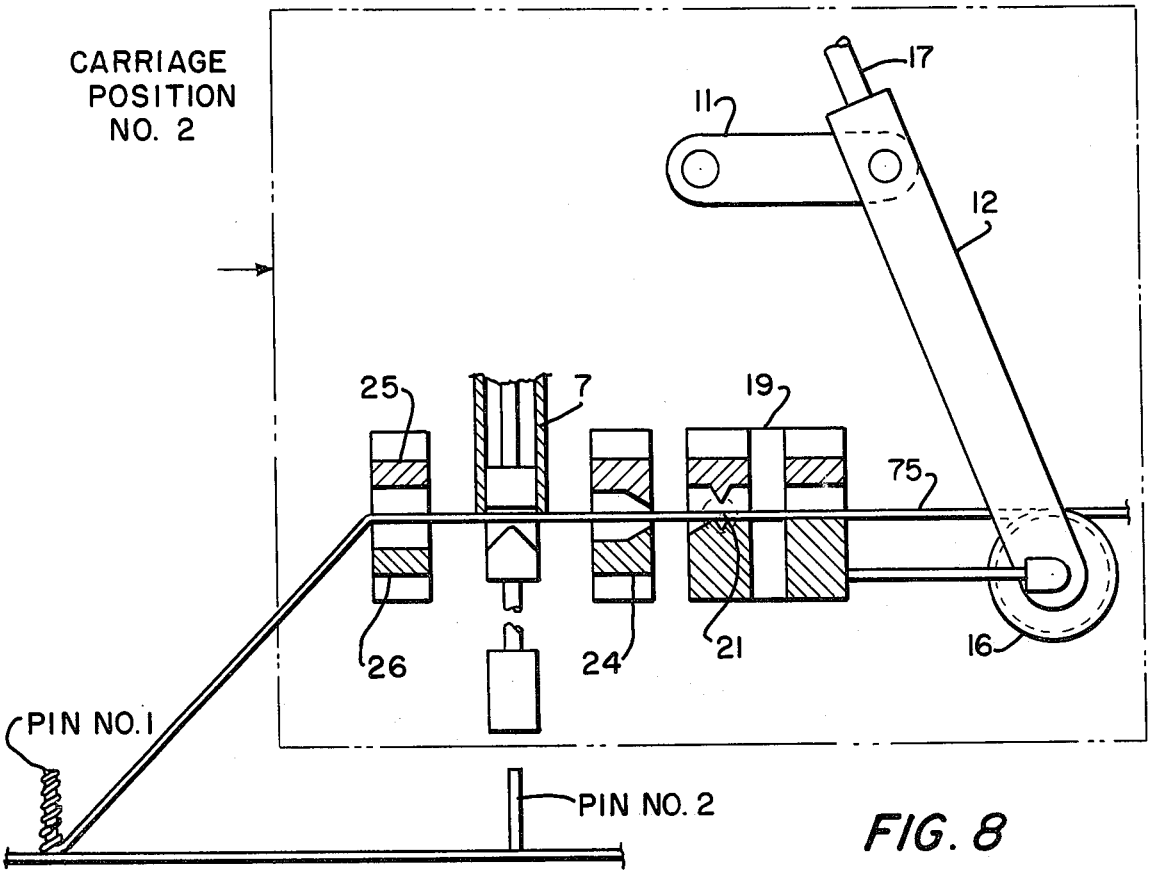
Figure 9:
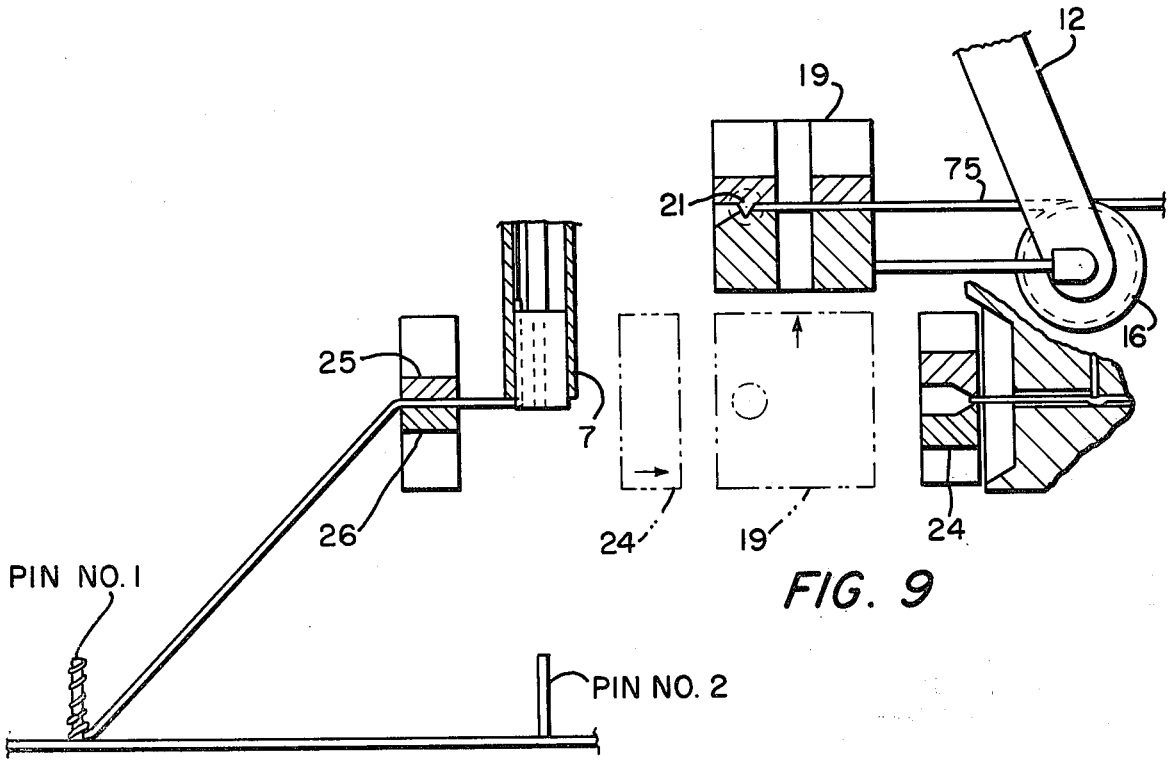

At this point the wire wrapping bit is moved by the X-Y positioning table to its new location over the second terminal pin of the connection to be wrapped. The wire feed pulley arm is then driven to the right through its arcuate path disposing the wire in position to be gripped by finger clamp 25, wire wrapping bit 3, stripper assembly 24, and wire cutter and gripper assembly 19 as shown in FIG. 8. Here the process sequence for clamping, stripping, and loading the wire as shown in FIGS. 5 through 7 is repeated for the second pin with the exception, however, that the wire extends from pin 1 progressing left to right through the finger clamp 25, wire wrapping bit 3 and the stripper assembly 24, and that the wire feed pulley is to the right of the wrapping bit. It will be noted that the cutter and gripper assembly 19 retains the wire from the dereeler during the stripping and wrapping sequence and that in this position as shown in FIG. 9, the wire is held ready for the start of the next connection sequence for pin 1 of the subsequent connection.

Figure 10:
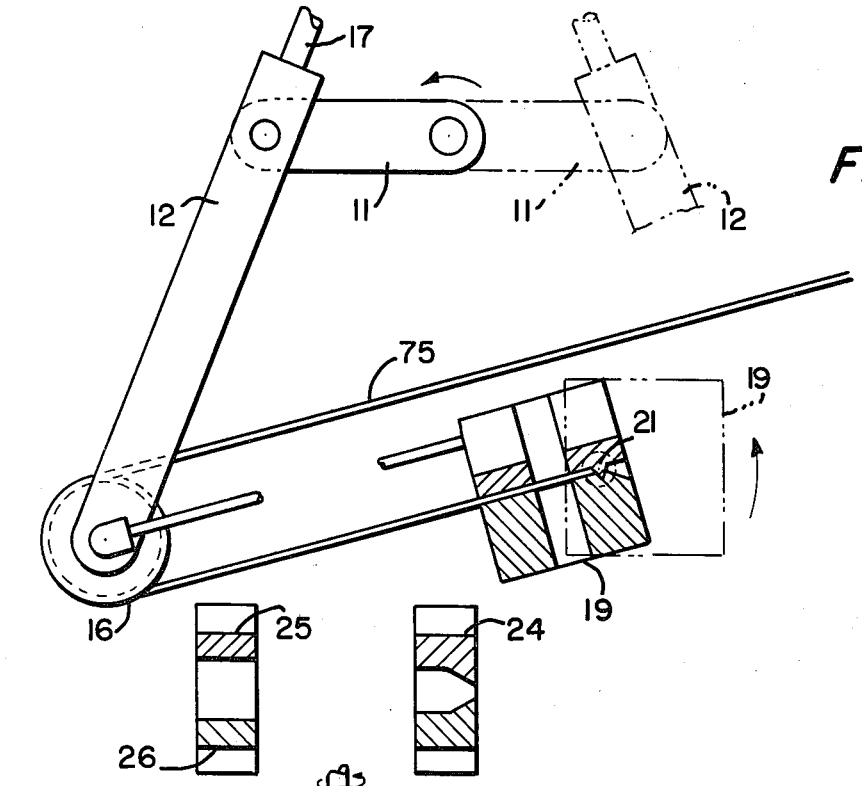

FIG. 10 shows the wire feeding sequence beginning for the subsequent wire connection as the wire wrapping bit is finishing the wrap of the second pin of the previous connection.

Figure 11:
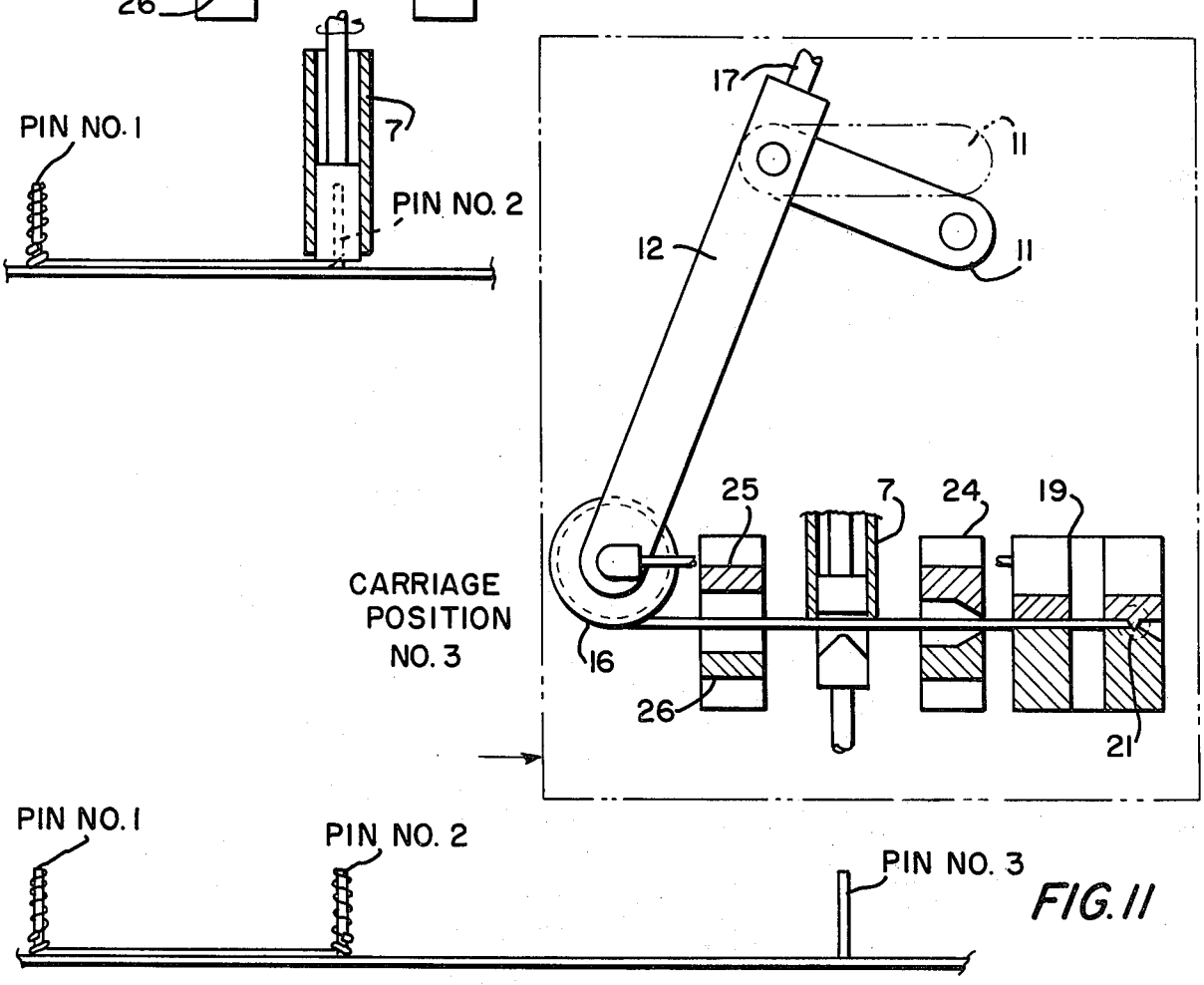

FIG. 11 shows the wire wrapping head positioned over the first pin of the subsequent connection (labeled pin 3). Again, the finger clamp and bench pin 26 have been positioned for clamping, the wire wrapping bit has been returned to the horizontal position and extended for loading. The wire stripper assembly 24 has been returned to its initial position and the cutter and gripper assembly lowered in position to dispose the wire in the various components for subsequent process which includes repeating the steps of FIG. 4 through FIG. 10 for each subsequent pair of wire terminals connected.

It will thus be appreciated that the unique apparatus of this invention is capable of providing a wire connection between two terminals with a single wire wrapping head, and that the unique features of the wire wrapping head allow positive control of the wire during the critical cutting, stripping, and capturing sequence. Also the unique loading feature of the wire wrapping bit in the horizontal position allows loading and capture of the wire end closer to the terminal to be wrapped and thereby produces a minimum wire loop between terminals. It can be appreciated by one skilled in the art that without the horizontal loading feature, it will be necessary for the wire wrapping bit to extend vertically downward for the exposed length of the bit, which must be at least as long as the longest stripped wire length plus a minimum length of the wrapping tip of the bit. For a versatile machine, this may be as much as 2 to 2½ inches, and will result in that much additional wire in the loop between pins. This would be troublesome to the further progress of the wrapping head and wasteful of connection wire. Several other unique features of the apparatus contribute to the overall success of the present invention.

The invention has been described, and one embodiment is shown in detail for purpose in aiding the understanding of the invention. It will be obvious to one skilled in the art that numerous modifications of the apparatus are possible to accomplish the invention as the same will now be understood. I do not wish to be limited in the scope of my invention except by the scope of the following claims:

I claim:

1. A wire wrapping apparatus for interconnecting electrical terminals comprising:

a rotary wire wrapping tool;

a means for feeding insulated wire of an indeterminate length to said tool;

means for receiving and loading said wire on said tool including clamp means separate from but adjacent said tool;

stripping means separate from but adjacent said tool for removing the wire insulation;

cutting and gripping means for cutting to length and securing sequentially alternate ends of the wire; and said cutting and gripping means is mounted for rotation about an axis offset from and adjacent to said rotary wire wrapping tool and is rotated separately from said rotary wire wrapping tool.

2. A wire wrapping apparatus of claim 1 wherein:

rotation of said cutting and gripping means is accomplished by said means for feeding insulated wire.

3. The wire wrapping apparatus of claim 1 wherein:

said rotary wire wrapping tool further comprises;

a motor means;

a wrapping bit;

a bit holder; and means for applying a constant force axially along said bit means.

4. The wire wrapping apparatus of claim 3 wherein:

said wrapping bit is provided with a wire receiving slot and a first wire retaining means for controlling the wire before it is loaded into the wrapping bit; and a second wire retaining means for controlling the wire after it is loaded into said wrapping bit.

5. The wire wrapping apparatus of claim 4 wherein:

said first wire retaining means comprises a notch in said bit which cooperates with said bit holder means.

6. The wire wrapping apparatus of claim 4 wherein:

said second wire retaining means comprises a discontinuity in said wire receiving slot.

7. The wire wrapping apparatus of claim 3 wherein:

at least said wire wrapping bit and said bit holder are advanced towards the electrical terminals by a positioning drive means whereby said bit and bit holder may be positioned at any wrap level.

8. The wire wrapping apparatus of claim 7 wherein:

the advance towards and away from the terminal is monitored by position detection means.

9. The wire wrapping apparatus of claim 8 wherein:

said position detection means is a LVDT transducer.

10. The wire wrapping apparatus of claim 9 wherein:

the signal of said position detection means is utilized as a means of detecting the wrap function of the apparatus.

11. The wire wrapping apparatus according to claim 7 wherein:

said positioning drive means for "Z" level position comprises a stepping motor and ball screw drive.

12. The wire wrapping apparatus of claim 1 wherein:

said means for feeding insulated wire comprises a wire feed pulley mounted on linkage means for accurately positioning said wire feed pulley to a position sequentially to the right and left of said wire wrapping tool.

13. The wire wrapping apparatus of claim 12 wherein:

said linkage means is operatively connected to said wire cutting and gripping means; and movement of said linkage means causes said cutting and gripping means to rotate about its axis.

14. The wire wrapping apparatus of claim 3 wherein:

said wrapping bit and bit holder cooperate to capture the insulated wire prior to stripping and loading of the stripped wire in the bit for wrapping.

15. The wire wrapping apparatus of claim 1 wherein:

said rotary wire wrapping tool is loaded in a plane parallel to the plane of the terminal board; and wherein said wire wrapping tool is moved to a position perpendicular to the said terminal board for purposes of wrapping said wire on the electrical terminal.

16. The wire wrapping apparatus of claim 14 wherein:

said wrapping bit is provided with an axial drive means in a loading position and with rotary drive means in a wrapping position.

17. The wire wrapping apparatus of claim 1 wherein:

said cutting and gripping means is adjustable with respect to said rotary wire wrapping tool to accomplish various strip lengths of said insulated wire.

18. The wire wrapping apparatus of claim 1 wherein:

said cutting and gripping means is translated relative to said stripping means whereby stripping of said insulated wire may be accomplished.

19. A wire wrapping apparatus for interconnecting electrical terminals comprising:

a rotary wire wrapping tool having a wire wrapping bit;

a means for feeding insulated wire of an indeterminate length to said wrapping bit;

a means for receiving and loading said wire on said wrapping bit;

clamp means separate from but adjacent to said wrapping bit for securing said insulated wire;

stripping means separate from but adjacent to said wrapping bit for removing the wire insulation;

said stripping means being located on the opposite side of said wrapping bit from said clamp means;

cutting and griping means adjacent to said stripping means for cutting said insulated wire to length and securing alternate ends of the wire during the wire wrapping sequence;

said gripping means, said wrapping bit, said stripping means, and said cutting and clamping means having at least one operating position lying in a straight line such that the insulated wire may be conveniently disposed through the operating position;

said wrapping bit having a first loading position in said one operating position; and said wrapping bit having a second wrapping position substantially perpendicular to said first loading position.

20. The apparatus of claim 19 wherein:

said means for feeding insulated wire comprises a constant force wire dereeler.

21. The apparatus of claim 19 wherein:

said means for receiving and loading on said wire feed comprises a wire feed pulley means; and said wire feed pulley means being disposed on linkage means for transporting said wire feed pulley means from a position to the right of said rotary wire wrapping tool to a position to the left of said rotary wire wrapping tool.

22. The apparatus of claim 19 wherein:

said clamp means comprises a rotatable finger clamp which cooperates with a movable clamping surface means for securing said insulated wire in one position and allowing the wire to pass through the plane of said clamp means in another position.

23. The apparatus of claim 19 wherein:

said stripping means further comprises a rotatable mounting means;

an actuating finger means;

a return spring means;

a fixed stripping blade;

and a movable stripping blade; and said movable stripping blade being movable to a position away from said fixed stripping blade by said actuating finger means to receive said insulated wire, and movable to a position abutting, said fixed blade by said return spring whereby said insulated wire is notched for easy insulation removal.

24. The stripping means of claim 23 wherein:

rotation of said stripping means about its rotatable mounting means removes the insulation of said insulated wire in line with the axial projection of said insulated wire and deposits the stripped insulation out of the line of actual projection of said insulated wire.

25. The apparatus of claim 19 wherein:

said cutting and gripping means is rotatably mounted for receiving said insulated wire in one direction and subsequently allowing its direction of receipt to change without changing the relative position of the wire end to said rotary wire wrapping tool and without requiring the looping of wire.

26. The apparatus of claim 19 wherein:

said cutting and gripping means is rotatable about an axis passing through the cutting point.

27. The apparatus of claim 19 wherein:

said cutting and gripping means is utilized to cut and grip sequentially each end of the insulated wire to be wrapped onto interconnecting terminals.

28. The apparatus of claim 19 wherein:

said cutting and gripping means further comprises a spring loaded gripper plunger for positively controlling the insulated wire after said wire has been severed by said cutting and gripping means.

29. The apparatus of claim 19 wherein:

said cutting and gripping means is rotated about an axis passing through the plane of said cutter of said cutting and gripping means by control arm means operatively associated with said means for receiving and loading said wire on said wrapping bit.

30. The apparatus of claim 29 wherein:

said control arm means is rigidly connected to said cutting and gripping means at one end and slidingly connected to said means for receiving and loading said wire on said wrapping bit at its other end.

31. The apparatus of claim 19 wherein:

said wrapping bit in its first loading position; and said stripper means are operatively associated with a common shuttle block drive.

32. The apparatus of claim 19 wherein:

said means for receiving and loading said wire on said wrapping bit and said cutting and gripping means are mounted for vertical movement with relationship to the remainder of said wrapping apparatus.

33. The apparatus of claim 19 wherein:

said wrapping bit is provided with wire control means operable at least during the stripping and wrapping of the wire; and said bit is provided with compound cone means for assisting in the camming and wrapping of the wire on the terminal.

34. The apparatus of claim 33 wherein:

said compound cone means is comprised of cone segments of approximately 30° and 45° from the bit axis.

* * * * *